US007007338B2

(12) United States Patent
Garabedian, Jr. et al.

(10) Patent No.: US 7,007,338 B2
(45) **Date of Patent: *Mar. 7, 2006**

(54) ADVANCED AEROSOL CLEANING SYSTEM

(76) Inventors: Aram Garabedian, Jr., 1221 Broadway, Oakland, CA (US) 94612; Michael J. Hall, 1221 Broadway, Oakland, CA (US) 94612; Maria G. Ochomogo, 1221 Broadway, Oakland, CA (US) 94612; Marcus Wang, 1221 Broadway, Oakland, CA (US) 94612; Andrew Kilkenny, 1221 Broadway, Oakland, CA (US) 94612; Kaj A. Johnson, 1221 Broadway, Oakland, CA (US) 94612; Thomas Silk, 1221 Broadway, Oakland, CA (US) 94612; Michael H. Robbins, 1221 Broadway, Oakland, CA (US) 94612; Aaron R. London, 11612 Rabaul Dr., Cypress, CA (US) 90630; Dennis Rich, 4392 Corporate Center, Los Alamitos, CA (US) 90720; Doug Walker, 4392 Corporate Center, Los Alamitos, CA (US) 90720

( * ) Notice: This patent issued on a continued prosecution application filed under 37 CFR 1.53(d), and is subject to the twenty year patent term provisions of 35 U.S.C. 154 (a)(2).

Subject to any disclaimer, the term of this patent is extended or adjusted under 35 U.S.C. 154(b) by 0 days.

(21) Appl. No.: 10/458,031

(22) Filed: Jun. 9, 2003

(65) Prior Publication Data

US 2004/0141798 A1 Jul. 22, 2004

Related U.S. Application Data

(63) Continuation-in-part of application No. 10/345,655, filed on Jan. 16, 2003, now abandoned.

(51) Int. Cl.

| | |
|---|---|
| ***A46B 11/04*** | (2006.01) |
| ***A46B 5/02*** | (2006.01) |
| ***A47L 13/46*** | (2006.01) |
| ***B43M 11/02*** | (2006.01) |

(52) U.S. Cl. ..... 15/231; 15/114; 15/115; 15/118; 401/279; 401/137; 401/138; 401/190; 401/270

(58) Field of Classification Search ..... 15/105, 15/114, 115, 231, 172, 142, 118; 401/279, 401/138, 137, 190, 270

See application file for complete search history.

(56) References Cited

U.S. PATENT DOCUMENTS

| | | | | |
|---|---|---|---|---|
| 605,533 | A * | 6/1898 | Worcester | 15/114 |
| 2,518,765 | A * | 8/1950 | Ecker | 15/115 |
| 2,828,501 | A * | 4/1958 | Brown, Sr. | 15/114 |
| 2,935,754 | A * | 5/1960 | Abdo et al. | 401/22 |
| 3,436,772 | A | 4/1969 | Stebbins | |
| 3,490,657 | A | 1/1970 | Williams et al. | |
| 3,541,581 | A | 11/1970 | Monson | |
| 3,600,325 | A | 8/1971 | Kaufman et al. | |
| 3,679,319 | A | 7/1972 | Munchel et al. | |
| D236,564 | S * | 9/1975 | Kaufman | D4/120 |
| 3,967,763 | A | 7/1976 | Focht | |
| 3,979,163 | A | 9/1976 | Beard | |
| 4,244,587 | A * | 1/1981 | Schweizer | 15/104.8 |
| 4,249,280 | A | 2/1981 | Goodrich | |
| 4,260,110 | A | 4/1981 | Werding | |
| 4,432,472 | A | 2/1984 | Lamm | |
| 4,479,277 | A * | 10/1984 | Gilman et al. | 15/111 |
| 4,589,994 | A | 5/1986 | Moseman | |
| 4,652,389 | A | 3/1987 | Moll | |
| 4,780,100 | A | 10/1988 | Moll | |
| 4,867,898 | A | 9/1989 | Spaulding et al. | |
| 4,969,854 | A | 11/1990 | Katsuda et al. | |
| 5,111,971 | A | 5/1992 | Winer | |
| 5,232,126 | A | 8/1993 | Winer | |
| 5,312,197 | A * | 5/1994 | Abramson | 401/6 |
| 5,503,303 | A | 4/1996 | LaWare et al. | |
| 5,589,448 | A | 12/1996 | Koerner et al. | |
| 5,789,364 | A | 8/1998 | Sells et al. | |
| 5,915,598 | A | 6/1999 | Yazawa et al. | |
| 5,918,340 | A * | 7/1999 | Young | 15/115 |
| 5,928,384 | A | 7/1999 | Scialla et al. | |

| | | | | |
|---|---|---|---|---|
| 6,013,615 | A | 1/2000 | Zhou et al. | |
| 6,017,561 | A | 1/2000 | Zhou et al. | |
| 6,080,387 | A | 6/2000 | Zhou et al. | |
| 6,270,754 | B1 | 8/2001 | Zhou et al. | |
| 6,284,723 | B1 | 9/2001 | Zhou et al. | |
| 6,336,240 | B1 * | 1/2002 | Laux et al. | 15/104.94 |
| 6,361,787 | B1 | 3/2002 | Shaheen et al. | |
| 6,454,876 | B1 | 9/2002 | Ochomogo et al. | |
| 6,482,392 | B1 | 11/2002 | Zhou et al. | |
| 6,551,001 | B1 | 4/2003 | Aberegg et al. | |
| 6,606,757 | B1 * | 8/2003 | Vosbikian et al. | 15/118 |
| 2001/0046407 | A1 | 11/2001 | Kunkler et al. | |
| 2002/0083964 | A1 * | 7/2002 | McKay | 134/6 |
| 2003/0009839 | A1 * | 1/2003 | Streutker et al. | 15/228 |
| 2003/0028988 | A1 * | 2/2003 | Streutker et al. | 15/228 |
| 2003/0052195 | A1 | 3/2003 | Aberegg et al. | |
| 2003/0052204 | A1 | 3/2003 | Aberegg et al. | |
| 2003/0053846 | A1 | 3/2003 | Kopanic et al. | |
| 2003/0074756 | A1 * | 4/2003 | Policicchio et al. | 15/228 |

FOREIGN PATENT DOCUMENTS

| | | |
|---|---|---|
| JP | 54042855 | 4/1979 |
| WO | WO 98/04666 | 2/1998 |
| WO | WO 01/72195 | 10/2001 |

OTHER PUBLICATIONS

D.J. Durian, "Foams," *Kirk-Othmer Encyclopedia of Chemical Technology*, (1994).

*Kirk-Othmer Encyclopedia of Chemical Technology*, 3rd Ed., vol. 22, pp. 332-432 (Marcel-Dekker, 1983).

P.A. Sanders, *Handbook of Aerosol Technology*, 2nd Ed., (Van Nostrand Reinhold Co., 1979), pp. 348-353 and 364-367.

* cited by examiner

*Primary Examiner*—Randall Chin
(74) *Attorney, Agent, or Firm*—Monica Winghart; David Peterson

(57) ABSTRACT

An advanced cleaning system comprising cleaning compositions, pads, and implements provide effective cleaning of soft and hard surfaces. The system includes (a) a handle portion, the handle portion having a proximal end and a distal end, (b) a cleaning head portion that is attached to the distal end of the handle portion and that is adapted for use with a removable cleaning pad; (c) a cradle that is secured to the handle portion, and (d) a detachable cleaning aerosol reservoir for delivering cleaning fluid onto the surface to be cleaned adjacent the cleaning head portion, wherein the reservoir is positioned within the cradle.

27 Claims, 18 Drawing Sheets

ADVANCED AEROSOL CLEANING SYSTEM

CROSS REFERENCE TO RELATED APPLICATION

The present application is a continuation-in-part application of U.S. Ser. No. 10/345,655 filed on Jan. 16, 2003 now abandoned, which is incorporated herein.

FIELD OF THE INVENTION

The present invention relates to cleaning compositions, pads, and implements useful in removing soil from soft and hard surfaces. The compositions are preferably foaming cleaners and treatments. The cleaning implement includes a handle, a spray delivery device, and a cleaning head with a disposable pad attached thereto.

BACKGROUND OF THE INVENTION

Cleaning devices and systems for household and industrial applications that include a broad range of technologies are currently available. For example, the prior art is replete with variations of hand-held, cleaning-like devices. These conventional floor, ceiling, and/or wall cleaning devices typically are constructed of a rigid, elongated rod or pole having a handle portion at the proximal and a cleaning head at the distal end. The handle portion is held closer to the proximal end, while a cleaning head is placed at the distal end of the handle.

Recently, light-weight, hand-held mops with on-board liquid delivery systems and disposable cleaning pads have been developed. U.S. Pat. No. 6,540,424 to Hall et al. describes a mop system that delivers a liquid cleaner onto the surface to be cleaned via a mechanical, gravity-fed device. U.S. patent application Publication No. 2001/0046407 to Kunkler et al. describes an electrical pump fed mop system that employs a complex and expensive battery operated pump system to deliver the cleaning composition.

Aerosol dispensers for delivering cleaners for carpets and other surfaces are well known. Examples of various dispenser designs are disclosed, for example, in U.S. Pat. No. 2,761,594 to Stroh, U.S. Pat. No. 3,138,295 to O'Donnell, U.S. Pat. No. 3,269,614 to Henry, U.S. Pat. No. 3,373, 908 to Crowell, U.S. Pat. No. 3,429,483 to Micallef, U.S. Pat. No. 3,642,179 to Micallef, U.S. Pat. No. 3,887,115 to Petterson, U.S. Pat. No. 4,068,782 to Van der Heijden, U.S. Pat. No. 4,378,081 to van Lit, U.S. Pat. No. 4,805,839 to Malek, U.S. Pat. No. 3,967,763 to Focht, U.S. Pat. No. 5,027,986 to Heinzel et al., U.S. Pat. No. 6,145,704 to Geier, and U.S. Pat. No. 6,398,082 to Clark et al.

Generally, after the aerosol has been sprayed onto the carpet, the cleaning composition is scrubbed into the carpet and/or allowed to dry on the carpet before vacuuming. For example, U.S. Pat. No. 5,928,384 to Scialla and Raso describes a typical procedure whereby the carpet is rubbed or/and brushed with a mechanical/electrical device such as a sponge or a brush, optionally with the aid of water. Typically, the rubbing/brushing lasts for 0.1 to a few minutes per square meter until the dirt is removed. The dirt laden composition is then removed from the carpet by brushing and/or vacuuming. As is apparent, this technique requires an aerosol dispenser and one or more separate tools.

Aerosol assisted devices are also known in the art. For example, U.S. Pat. No. 4,969,854 to Katsuda et al. describes an applicator with an aerosol device for applying an insecticide directly to a surface through an absorbent strip running along the outside of the aerosol can. U.S. Pat. No. 3,679,319 to Munchel and Thornton describes a spray device for overhead surfaces having a pole with a U-shaped aerosol holder and optional dusting mop attachment. U.S. Pat. No. 3,490,650 to Mahwah and Neal describes a rechargeable, pressurized, elongated plastic tube that delivers a cleaning composition to a mop head. U.S. Pat. No. 4,432,472 to Lamm describes an optional aerosol attachment to a floor buffing machine. U.S. Pat. No. 4,249,280 to Goodrich describes a vacuum cleaner bag pocket which can carry an aerosol carpet cleaner. U.S. Pat. No. 3,979,163 to Beard describes a scrub head attachment to an aerosol can. These devices are all fairly complicated.

It is desirable to have a simple, mechanical implement that delivers a cleaning composition under pressure and that works for both hard and soft surfaces, including carpets. The implement should be light weight and designed not only for horizontal floors and carpets but also for vertical and raised surfaces in and around the house.

SUMMARY OF THE INVENTION

The present invention is based in part on the development of a cleaning system that includes:

(a) a handle portion having a proximal end and a distal end;

(b) a cleaning head portion that is attached to the distal end of the handle portion and that is adapted for use with a removable cleaning pad; and (c) a detachable cleaning fluid reservoir for delivering cleaning fluid onto the surface to be cleaned adjacent the cleaning head portion.

In one aspect, the invention is directed to a cleaning head assembly adapted for use with a removable cleaning pad that includes:

(a) a cleaning head member having a first surface and a second surface;

(b) bristles projecting from the cleaning head assembly, wherein the bristles are (i) fixed on the first surface or (ii) attached to an elongated member that is removably attached to the cleaning head member; and (c) means for securing a cleaning pad to the cleaning head member.

In another aspect, the invention is directed to a cleaning head assembly having a removable cleaning pad attached thereto that includes:

(a) a cleaning head member having a first surface and a second surface wherein the cleaning pad is secured to the first surface;

(b) bristles projecting from the first surface wherein the bristles are (i) fixed on the first surface or (ii) attached to an elongated member that is removably attached to the cleaning head member; and (c) means for securing a cleaning pad to the cleaning head member.

In a further aspect, the invention is directed to a cleaning pad, which is adapted to be removably attached to a cleaning head assembly that has (i) a first surface, (ii) a second surface, (iii) a receiving structure configured to accommodate a pole attachment, and (iv) means for securing the cleaning pad, wherein the cleaning pad includes: a sheet of material having a first surface and second surface wherein the sheet defines (i) a middle region having a contour that substantially matches that of the first surface of the cleaning head and (ii) a first side region and (ii) a second side region, and wherein at least one of the first side region or the second side region defines an open notched area such that when the first and second regions are folded onto the second surface, the open notched area has a perimeter that circumscribes at least a portion of the outer contour of a receiving structure.

In yet another aspect, the invention is directed to a cradle-canister assembly for supplying a pressure spray of cleaning fluid that includes:

(a) a cradle body member forming an internal passage having side walls with one or more alignment guides wherein the cradle body member defines an aperture through which the pressure spray emanates; and (b) a spray canister having a nozzle through which cleaning fluid flows, a valve with an actuator, and a cap adapted to be fixed to an outside surface of the canister wherein a portion of the outer surface of the cap is contoured to match the one or more alignment guides so that as the spray canister is inserted into the internal passage the one or more alignment guides receives the cap to facilitate the alignment of the nozzle to the aperture.

In still another aspect, the invention is directed to a spray canister, for use in a support cradle having an internal passage with side walls with one or more alignment guides wherein the support cradle defines an aperture through which a pressure spray of cleaning fluid emanates, wherein the spray canister includes: a canister having a reservoir containing a cleaning composition and gas propellant and having a nozzle through which cleaning product flows, a valve with an actuator, and a cap adapted to be fixed to an outside surface of the canister wherein a portion of the outer surface of the cap is contoured to match the one or more alignment guides so that as the spray canister is inserted into the internal passage the one or more alignment guides cooperates with the cap to facilitate the alignment of the nozzle to the aperture.

DETAILED DESCRIPTION OF THE INVENTION

Cleaning Implement

Figure 1:
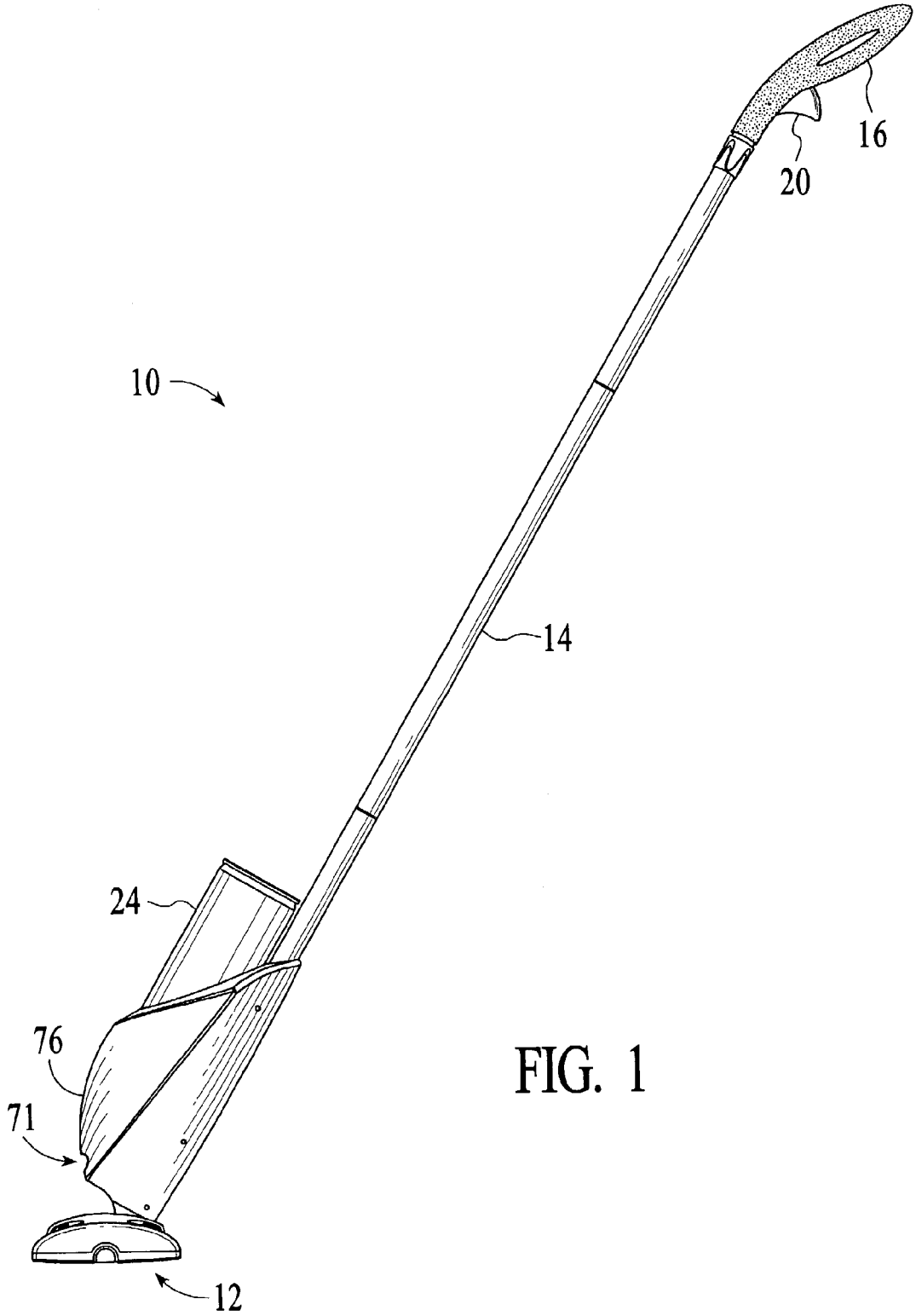
FIGS. 1–2 are side and perspective views, respectively, of the cleaning implement.

The cleaning implement of the present invention can be used to clean carpets, floors, windows, bathrooms, showers, tubs, toilets, automobiles, outdoor surfaces, and other soft and hard surfaces. As shown generally in FIG. 1, the cleaning implement 10 includes (i) a pole 14, (ii) primary handle 16 and a trigger 20 that is located at the base of handle, (iii) a cleaning head assembly (or cleaning head) 12, (vi) a holster or cradle 76, and (v) a spray canister 24 that is positioned in holster 76. In use, a cleaning fluid preferably in aerosol form is applied by trigger activation onto the surface to be cleaned through opening 71 of holster 26.

A. Handle and Pole

Figure 9:
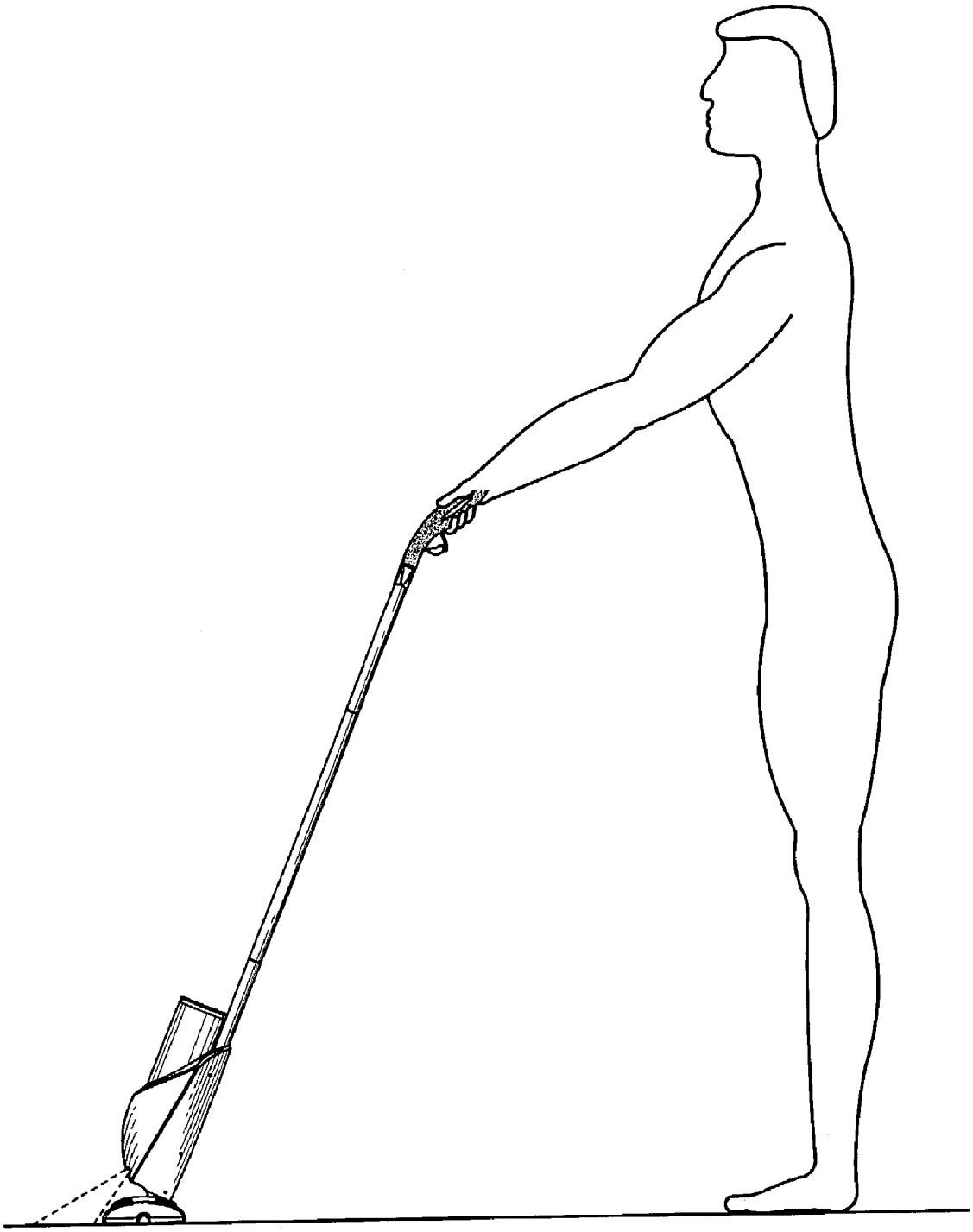
FIGS. 9 and 10 depict male and female figures, respectively, added in silhouette using the cleaning implement to depict relative scale.
Figure 10:
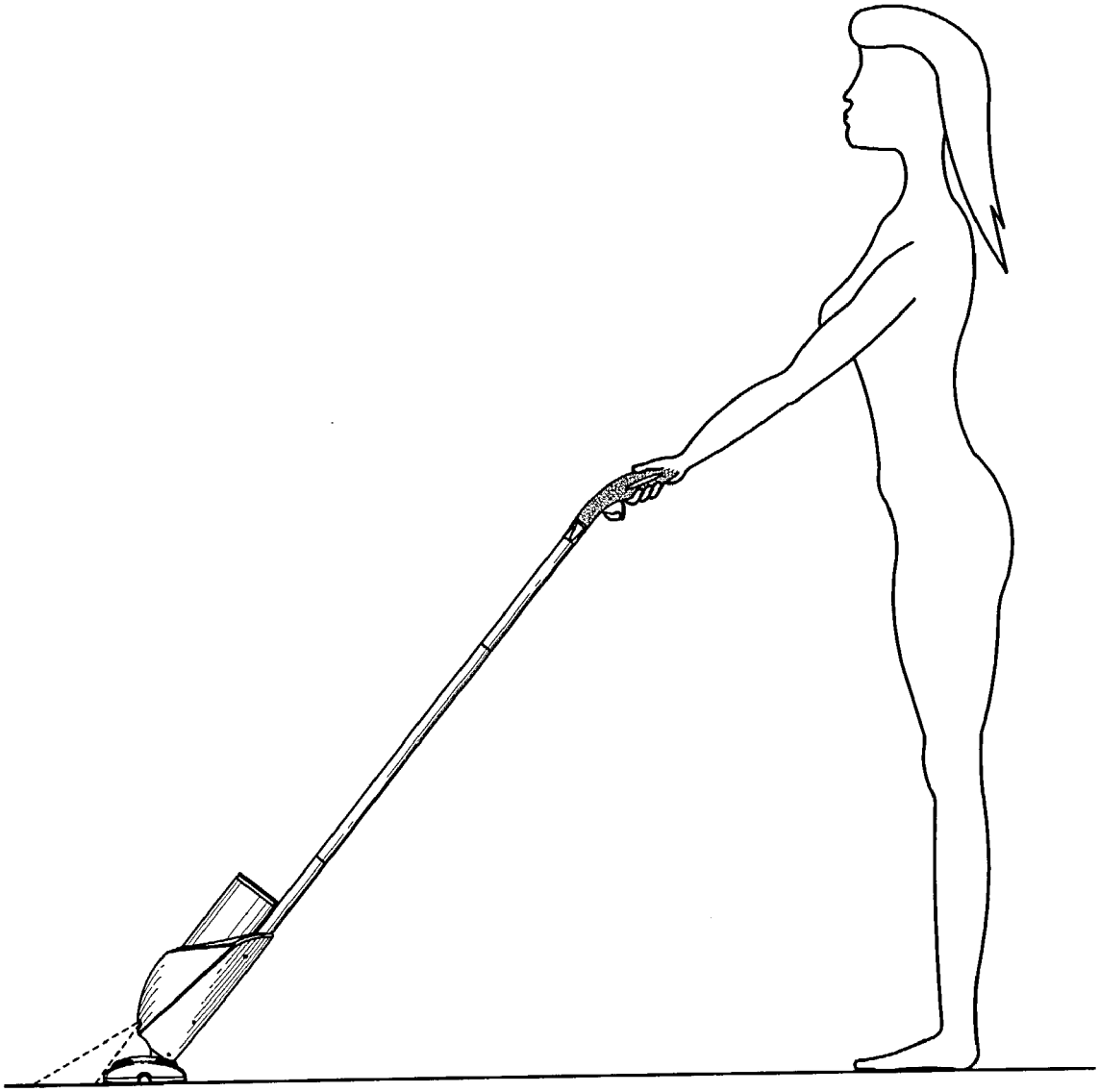

The oblong-shaped primary handle 16 is preferably fabricated from a light metal, e.g., aluminum, plastic, or wood, to provide a gripping surface for the consumer. The handle can include an optional aperture through the gripping surface as shown. A trigger 20 or other mechanism for actuating the canister is located at the base of the grip. To prevent accidental discharge of cleaning fluid, a trigger guard (not shown) can be integrated into handle. Handle 16 is connected to the proximal end of an elongated pole 14. The combined lengths of pole 14 and handle 16 are such that the user will actuate the cleaning system in an upright position. FIGS. 9 and 10 show the silhouettes of male and female users using the cleaning implement in upright positions.

The distal end of pole 14 is connected to cleaning head assembly 12 via a swivel joint that permits a user to swing pole 14 forward or backward relative to the cleaning heading assembly 12. The universal or swivel joint is preferably less than 1.0 in. (25.4 mm) and preferably is about 0.75 in. (19.1 mm) from the bottom of cleaning head 12 so that the user can provide maximum leverage to the scrubbing task. The cleaning head may be removably attached to the joint, so that multiple cleaning heads for different cleaning tasks can be used. The cleaning head or joint may also be limited in moveable positions to facilitate cleaning of different types of surfaces. In the case of carpet cleaning, limiting movement of the cleaning head may create greater cleaning leverage. The cleaning head may be limited in rotation, relative to the pole, to an angle of 15 to 80 degrees and more preferably from 25 to 60 degrees to provide optimum consumer satisfaction.

Pole 14 is preferably hollow and collapsible to facilitate shipping and storage. For instance, the parts that form pole 14 may be threaded, friction-fit, or configured with some other type of engagement which allows for sturdy assembly or reassembly. Preferably, the pole is fitted with a bayonet engagement for ease of correct alignment and assembly. The pole may be adjustable and extendable so than it can reach close surfaces such as counter-tops and showers, medium distance surfaces such as floors and carpets, and more distant surfaces such as windows and ceilings.

Figure 2:
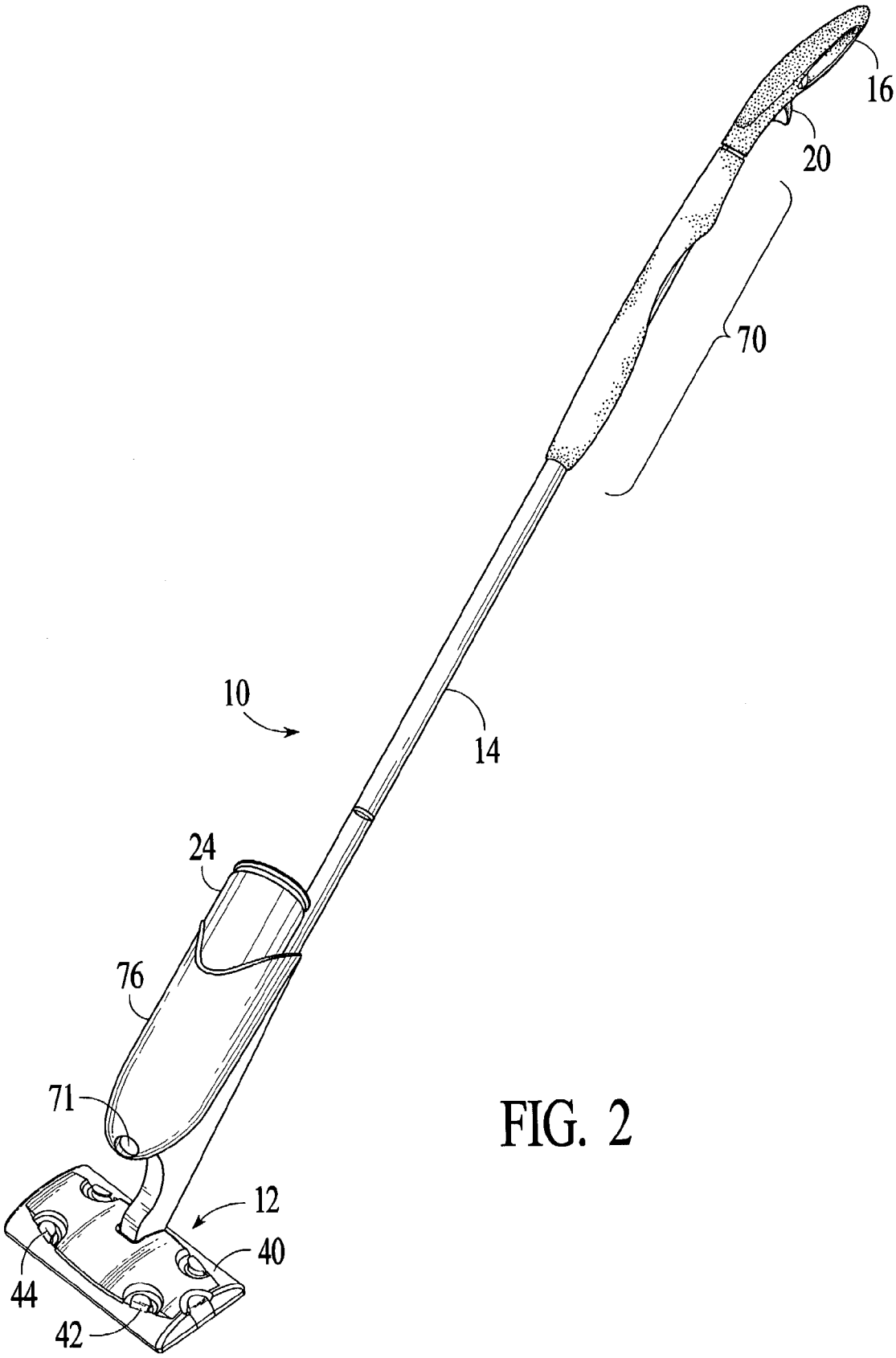

As illustrated in FIG. 2, pole 14 can also be equipped with a secondary handle grip 70 with which the user can apply additional leverage for easier scrubbing. The secondary handle grip preferably is 4 in. (101.6 mm) to 8 in. (203.2 mm) long and has an outer diameter that is about 1 in. (25.4 mm) wider than the pole diameter for greater ergonomic efficiency. Primary handle grip 16 and secondary handle grip 70 are each preferably designed and oriented to accommodate either the right- or left-hand of the user. In addition, either grip can incorporate soft or slip-resistant, ergonomic, or finger indented gripping surfaces.

Figure 3A:
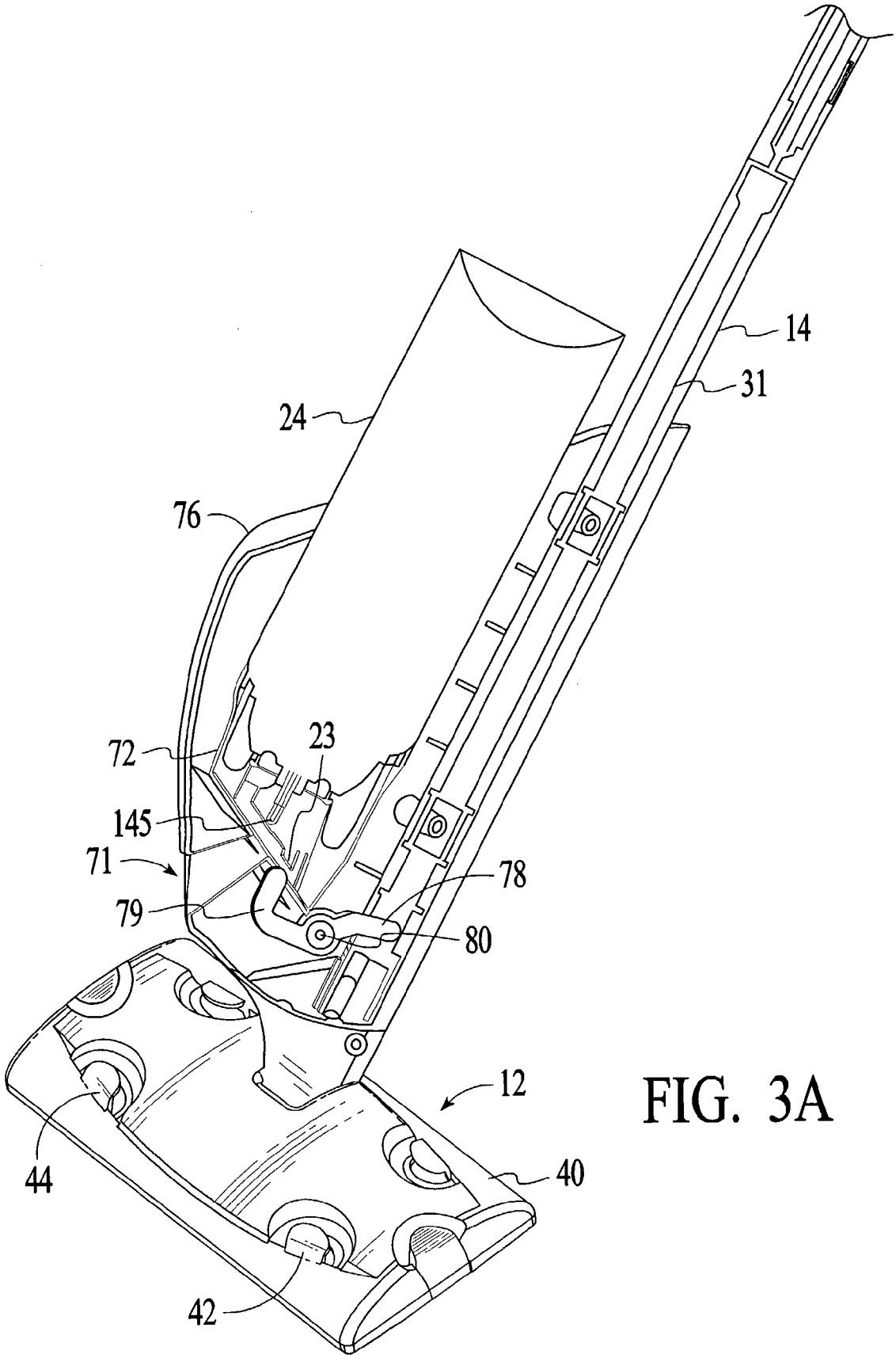
FIG. 3A is a partial exploded view of the cradle and canister.

FIG. 3A shows the activation mechanism of the cleaning implement in which a first end of rod 31 within pole 14 is connected to an activation lever with arms 78,79 and which is pivotally connected to fixed pin 80 within cradle 26. The second end of rod 31 is connected to the trigger (not shown). Pole 14 is attached to cleaning head 12 onto which a cleaning pad 40 is attached with the aid of stays 42, 44. Positioned within cradle 26 is canister 24 with its cap 72 properly arranged so that nozzle 145 of the canister is aligned with aperture 71. Cap 72 includes a valve actuator 23 which is hingedly connected to the cap. The canister contains a pressurized cleaning fluid as further described herein.

In operation, when the trigger is pressed by the user, rod 31 engages arm 78 which in turn causes arm 79 to push against valve actuator 23 thereby allowing the pressurized cleaning fluid to be released from nozzle 145 and through aperture 71 and ultimately onto the surface to be cleaned. The cleaning fluid continues to be sprayed until the user releases the trigger.

Figure 3B:
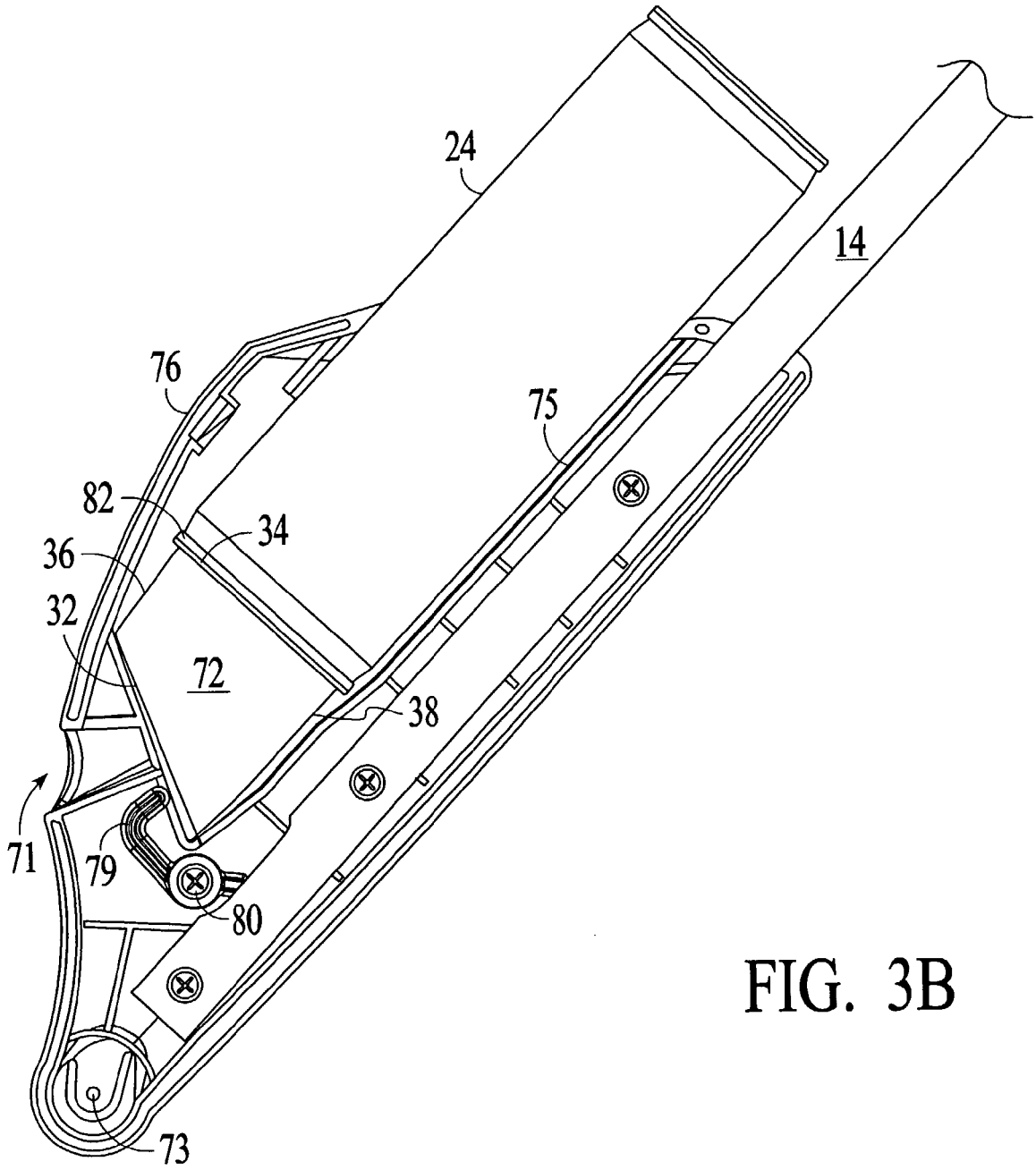
FIG. 3B is a cross-sectional view of the cradle and canister.

FIG. 3B is another depiction of canister 24 that is situated within an internal passage of cradle 76. The contour of the internal passage substantially matches that of the exterior configuration of cap 72 and canister 24. The internal passage is defined by rib structure 75 which is described further herein. As is apparent, the upper surface 32 of cap 72 facing aperture 71 preferably is slanted while its lower planar surface 34 is frictionally attached to a ridge (not shown) that is immediately adjacent chime 82 of canister 24. As a corollary, the lower side surface 36 of cap 72 is shorter than that of the upper side surface 38. Finally, at the distal end of pole 14 is pin 73 that connects to a corresponding notch on the cleaning head thereby forming the swivel joint.

Figure 4:
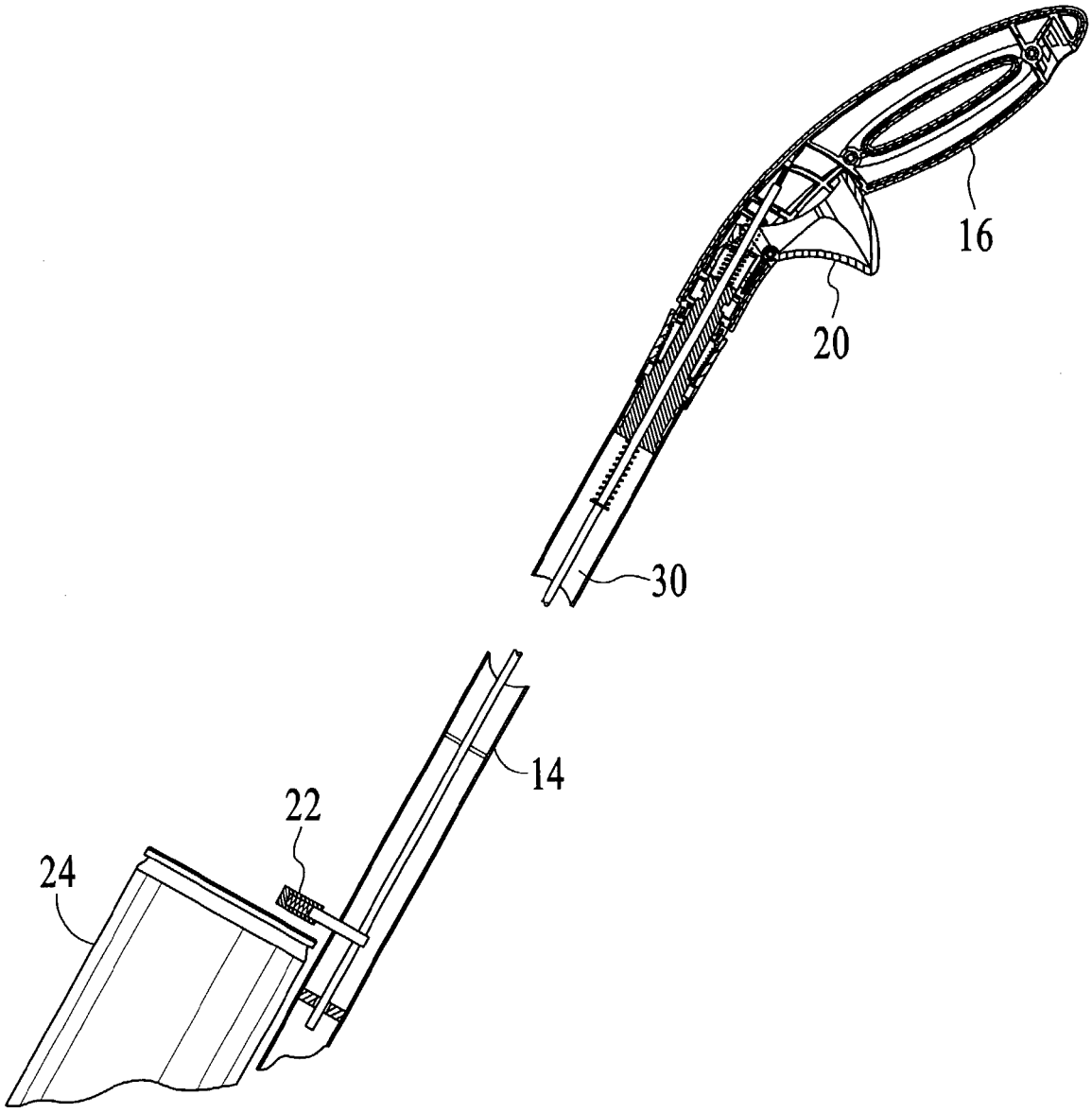
FIG. 4 is a partial exploded view of the handle of the cleaning implement.

FIG. 4 depicts the internal mechanism in the upper portion of pole 14 and handle 16 of another embodiment of the cleaning implement. The trigger 20 is connected via biasing spring rod 30 to actuator 22 that exerts a downward force onto aerosol canister 24 when the trigger is engaged. This in turn causes the cleaning composition to be propelled from pressurized canister 24.

B. Canister Cradle or Holster

Figure 8B:
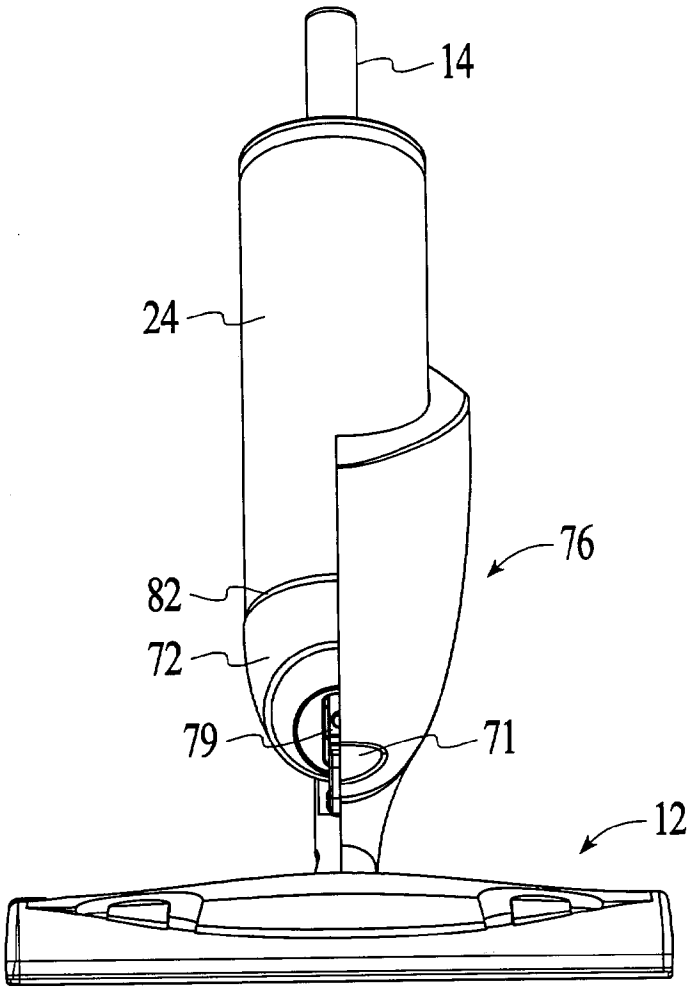
FIGS. 8A and 8B are partial exploded views of the left and front, respectively, depicting the canister loaded into the loading holster or cradle of the cleaning implement.
Figure 8A:
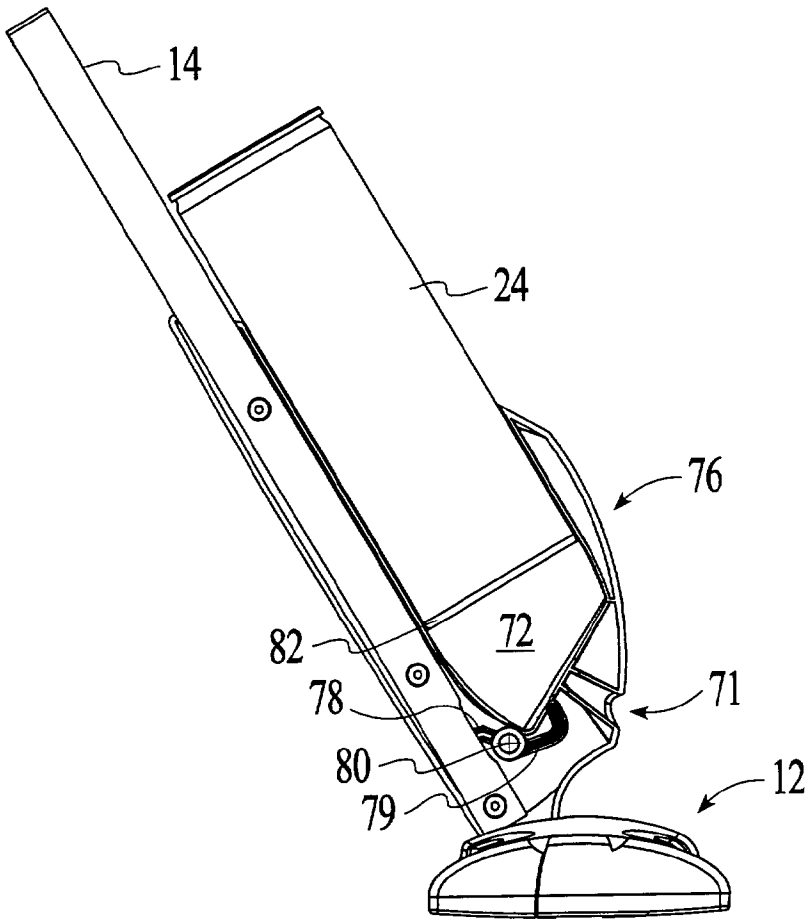

The canister cradle is preferably attached to the front or back side of the pole. As shown in FIGS. 8A and 8B, canister cradle 76, which is attached to the front of pole 14, is preferably an integral extension of pole 14, with canister 24 and pole 14 positioned parallel to the same centerline so as to be positioned in tandem relative to the user. In this configuration, the user has a good line of sight to the surface being cleaned. Canister cradle 76 is preferably assembled from two molded plastic (left and right) pieces that are secured to pole 14 with screws or the like. Canister cradle 76 when assembled defines an internal passage into which aerosol canister 24 (or any other cleaning composition container) is positioned so that the nozzle of canister 24 is aligned with opening 70 of the cradle through which the cleaning composition is sprayed. Opening 70 is preferably oval or rectangular shaped with the length as measured along the horizontal axis being 1.5 to 3 times the width as measured along the vertical axis. Positioned at the lower end of cradle 76 is activation lever, which has arms 78,79, is pivotally mounted with screw 80.

In relationship to the embodiment of the cleaning implement as illustrated in FIGS. 3A and 3B, arm 78 is coupled to the distal end of an internal rod that traverses the length of the hollow pole 14. (The rod is denoted by reference number 31 in FIG. 3A.) When the trigger of the cleaning implement is pressed, the rod translates the force to cause arm 78 to engage the valve actuator 23 of canister 24 thereby releasing a pressurized cleaning composition.

Operation of the actuator valve is slightly different in relation to the embodiment of the cleaning implement as illustrated in FIG. 4. Specifically, arm 78 would not be coupled to an internal rod, rather, as shown in FIG. 4, rod 30 is connected to actuator 22 which exerts a downward force on canister 24 when trigger 20 is pressed. The actuator valve of canister 24 is then engaged thereby releasing a cleaning composition. For the embodiment of FIG. 4, arm 78 can be stationary.

The interior walls of canister cradle 76 which define the contours of the internal passage have guide rails or ribs that facilitate alignment of the canister nozzle to opening 71.

Figure 3C:
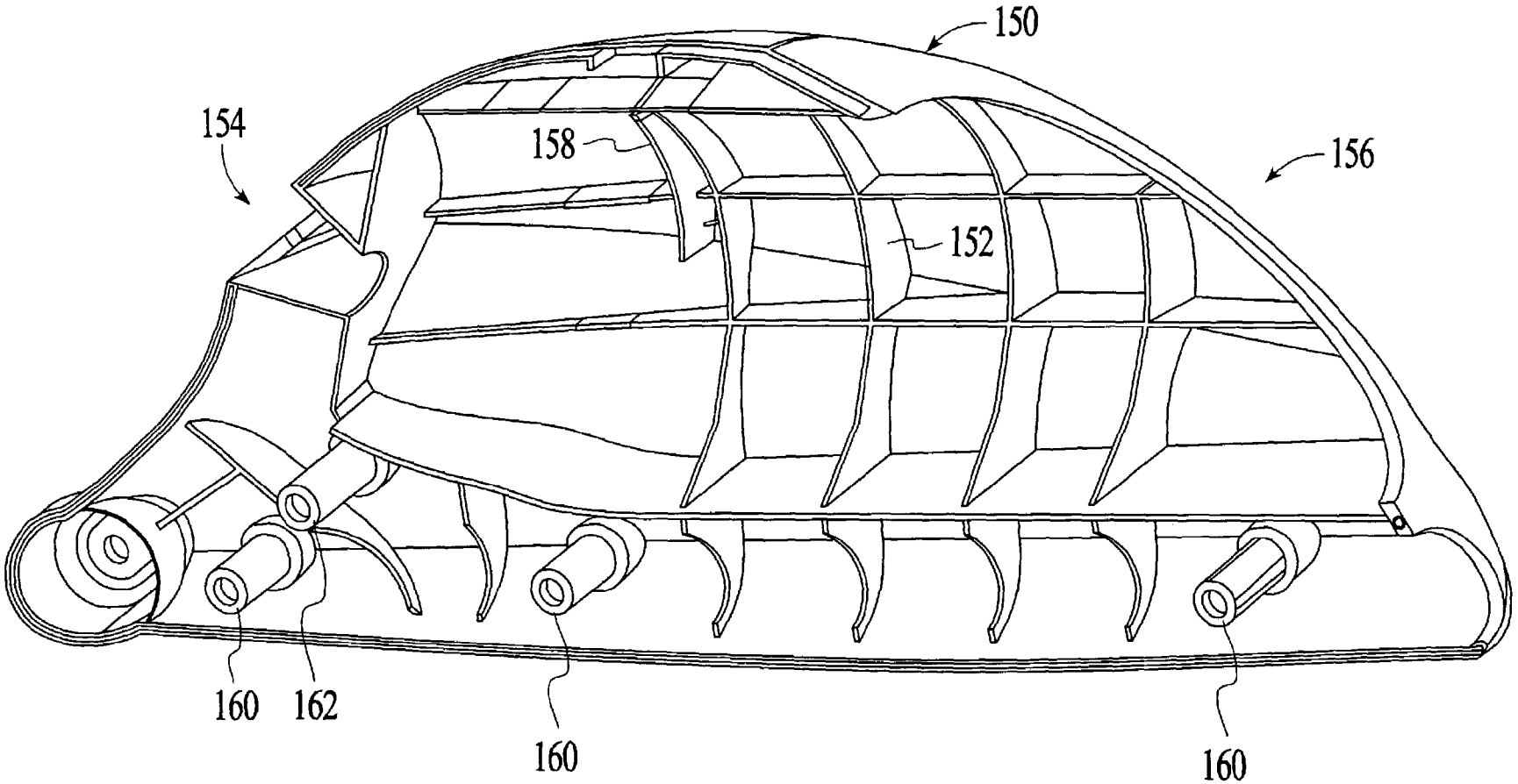
FIG. 3C shows the interior ribs of the cradle.

FIG. 3C depicts the internal rib structure of one of the two symmetrically shaped molded halves that form the cradle when the two halves are mated. As illustrated, molded frame 150 which is preferably made of plastic has a relatively thin, exterior shell that is supported by an internal rib matrix 152 which includes a cradle latch 158. Frame 150 includes a plurality of threaded connectors 160 designed to secure frame 150 to a corresponding second frame and to support a pole in-between. In addition frame 150 includes threaded connector 162 for securing an actuating lever with a pivot pin or screw 80 as shown in FIG. 3B. Frame 150 includes apertures 154 and 156 located at opposite ends of the internal passage. First aperture 154 serves as the exit for the cleaning fluid emitted from the canister and second aperture 156 is the entrance through which a capped canister is inserted.

The contour of the asymmetric internal passage of the cradle matches that of the exterior surfaces of the cap and canister. In this fashion, once the canister is maneuvered into the internal passage, the nozzle of the canister is automatically aligned with aperture 154. Referring to FIG. 3B, canister 24 can be readily inserted into the cradle by pushing it through the internal passage and at the same time rotating the canister, if necessary, in either direction until it is latched in place as further described herein. Thus, the internal passage cooperates with the external surface of the cap and functions as a guide for properly orienting the canister.

Figure 3D:
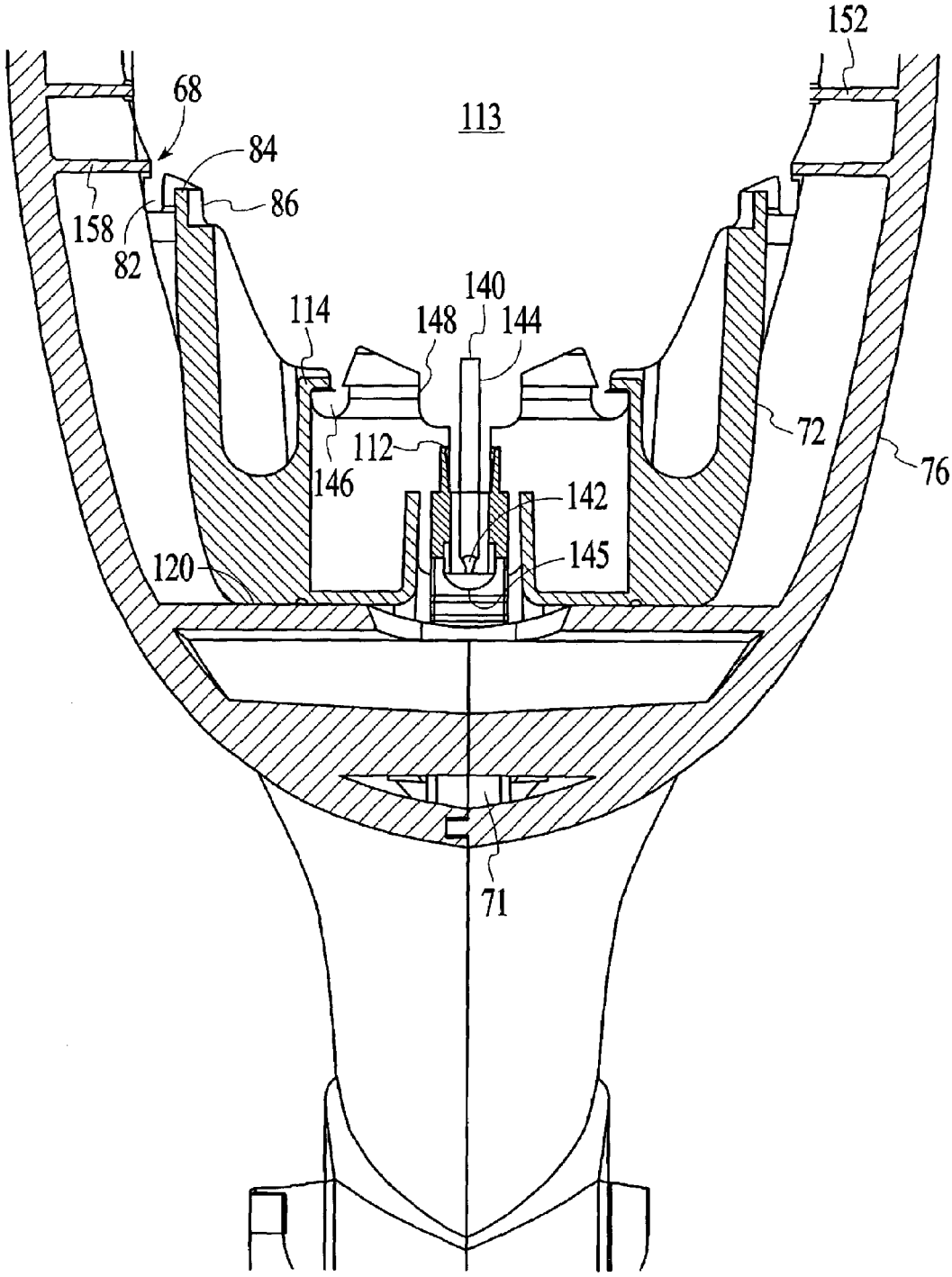
FIG. 3D is a partial front cross-sectional view of the cradle and canister.

FIG. 3D illustrates the relative positions of the cap 72 and aperture 71 when the canister has been properly inserted inside the internal passage of cradle 76. As shown, the front exterior surface 120 of cap 72 fits snugly against the surface of the internal passage such that aperture 71 of the cradle is aligned with nozzle 145. The exterior surface of the canister is supported by rib matrix 152. Latch 158 abuts chime 82 of the canister so that the canister does not become dislodged while the cleaning implement is in use, transport, or storage. Alternately, latch 158 may abut a corresponding ridge in the cap, when the cap fits over the chime. Preferably the outer perimeter of the canister immediately adjacent chime 82 defines an indentation 68 into which the outer perimeter of latch 158 fits as shown. Latch 158 can be a ridge that circumscribes the internal passage or latch 158 can consist of one or more latch wings. In this fashion, when the canister is being inserted into the cradle, the user can feel when the canister is properly positioned by the "click" created when flexible latch 158 returns to its original configuration and comes to rest in the indentation after being pressed slightly apart as metallic chime 82 is forced pass the narrower latch 158. Alternately, latch 158 may be forced apart by a ridge in the cap. In addition, latch 158 creates the necessary opposing force to maintain the canister in place as the user sprays the cleaning fluid. As shown in FIG. 3B, in one embodiment of the cleaning implement, arm 79 of the activating lever pushes up against on valve actuator 23 of the canister to release cleaning fluid. Latch 158, which is resting over chime 82, prevents the force of arm 79 from pushing the canister out of position.

As further illustrated in FIG. 3D, perimeter 84 of cap 72 is affixed to outer rim 84 that is located at the valve end of the canister. The valve end also includes an inner annular rim 146 to which inner annular ridge 114 of cap 72 is attached. The canister valve includes a mechanism (shown schematically) that permits cleaning fluid to be controllably released from chamber 113 of the canister. The proximal end 140 of hollow stem 144 is positioned within cleaning fluid-filled chamber 113 while its distal end 142 is in communication with nozzle 145 which has an orifice designed to spread the cleaning composition in a desired pattern. The stem is located within the bore of nozzle socket 112. Flow of the cleaning composition through stem 144 is regulated by valve 148. Stem 144 is held within the valve with a spring or other similar device. In this embodiment, when the user presses the trigger of the cleaning implement, force from the arm of the actuating lever pushes nozzle socket 112 into valve actuator 148 and thereby releasing the cleaning composition through nozzle 145.

While nozzle 145 with its orifice can be a separate component that is attached to the tapered distal end 142 of stem 144, as further described herein, nozzle 145 is preferably fabricated as an integral part of the cap which is then fitted onto the distal end 142 of stem 144. The nozzle orifice is preferably dimensioned so that the cleaning fluid exits as fine particles and not as a fluid stream. The process of developing fine particles is also commonly referred to as "atomizing."

For the embodiment shown in FIG. 3D, outer rim 84 of the cap is attached to indentation 68 of the canister, which is adjacent to chime 82, while annular ridge 114 of the cap is attached to inner annular rim 146 of the canister. Alternatively, in another embodiment, only annular ridge 114 of the cap, which is also referred to as the valve rim, is secured to inner annular rim 146 of the canister. Outer rim 84 of the cap is not secured within indentation 68 of the canister.

C. Cleaning Head Assembly with Cleaning Pad

As illustrated in FIG. 2, cleaning head assembly 12 is attached to the distal end of pole 14. A cleaning pad 40 is wrapped around the lower surface of cleaning head assembly 12 with four portions thereof affixed, tucked or looped into stays 42 and 44 on the upper surface of cleaning head assembly 12.

Figure 5:
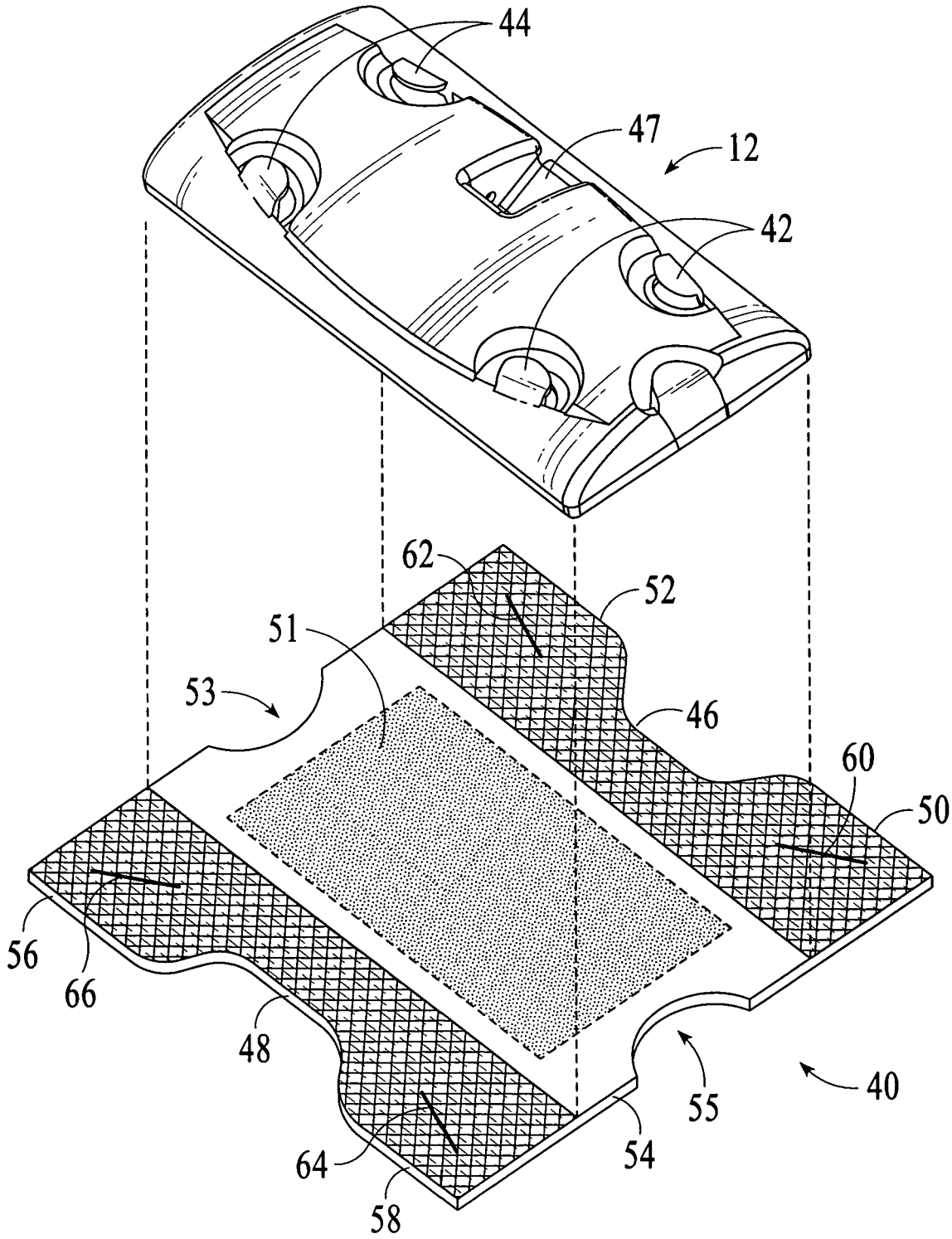
FIG. 5 is an exploded view of the head assembly and a disposable cleaning pad of one embodiment of the cleaning implement.

FIG. 5 illustrates the arrangement of a cleaning pad 40 relative to cleaning head assembly 12 that has stays 42, 42 and 44, 44 on its upper surface. Cleaning pad 40 is preferably made of a non-woven material that can be textured to afford abrasive cleaning action. Pad 40 has a middle section 54 whose rectangular dimensions match those of the lower surface of the cleaning head assembly. The center region 51 is made of an absorbent material and the perimeter around region 51 preferably includes an adhesive to affix the cleaning pad to the cleaning head 12. Pad 40 can also include notches 46 and/or 48 to permit cleaning pad 40 to be easily wrapped onto the upper surface of cleaning head assembly 12 without interfering with the movement of the pole. In this case, only notch 46 is required since the pole is connected to the side of the upper surface with recessed structure 47 for receiving and securing the distal end of the pole. Preferably recessed structure 47 has notches or holes on its side that accommodate pins 73 located at the distal end of pole 14 as shown in FIG. 3B.

The foldable wings 50, 52, 56 and 58 define the four corner edges of pad 40. To secure these wings to the stays located on the curved upper surface of the cleaning head assembly 12, slits 60, 62, 64 and 66 are slotted to correspond to the stays 42, 42 and 44, 44. The substantially linear slits may be cut at an angle of 0 to 90 degrees relative to the side of the pad and preferably at an angle of 80 degrees as shown. The slits are preferably from 0.5 in. (12.7 mm) to 2 in. (50.8 mm) long and from 0.05 in. (12.7 mm) to 1 in. (25.4 mm) wide. The slits may be dyed or printed a color different from the other pad materials or otherwise identified.

As illustrated in FIG. 5, cleaning pad 40 is dimensioned to fit onto cleaning head 12 and has notches 46, 48. The cleaning pad may have other optional cut-out regions 53, 55 on the side portions of the cleaning pad that are not folded to minimize interference and allow proper engagement of the rake brush or other cleaning accessory, as further described herein. The side cut-out regions are preferably arc shaped or curved. The arc may have a length of from 1 in. (25.4 mm) to 6 in. (152.4 mm) and a maximum width of from 0.25 in. (6.35 mm) to 4 in. (101.6 mm). Preferably, the length is from 1.5 in. (38.1 mm) to 4 in. (101.6 mm) and more preferably from 2 in. (50.8 mm) to 3 in. (76.2 mm). Preferably, the maximum width is from 0.4 in. (10.2 mm) to 2 in. (50.8 mm) and more preferably from 0.5 in. (12.7 mm) to 1 in. (25.4 mm). The cleaning pad can also have curved cut-outs around each corner or slit.

Besides being affixed onto stays, the cleaning pad may also be attached to the cleaning head with hook and loop type fasteners which are commercially available under the trade name VELCRO, or the cleaning pad may be attached with adhesives.

Figure 6A:
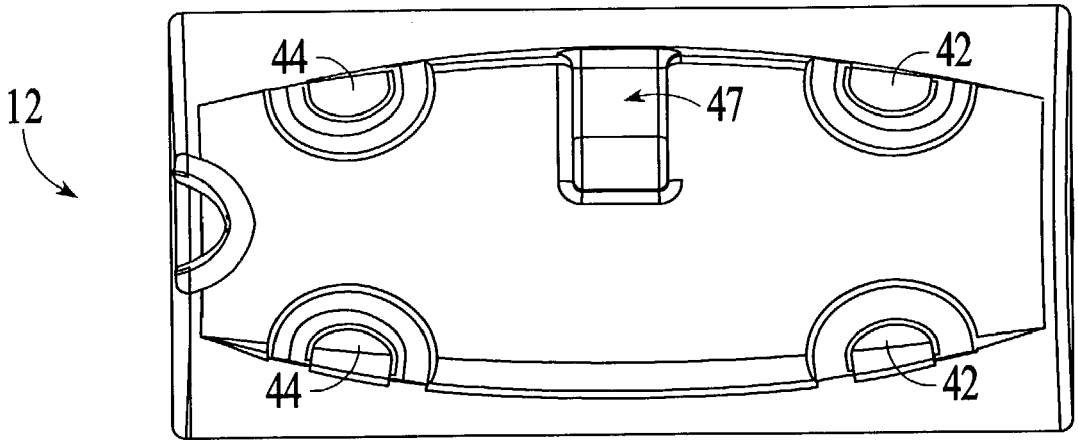
FIGS. 6A, 6B, and 6C are the top plan, front and bottom plan views, respectively, of the head assembly of one embodiment of the cleaning implement.
Figure 6B:
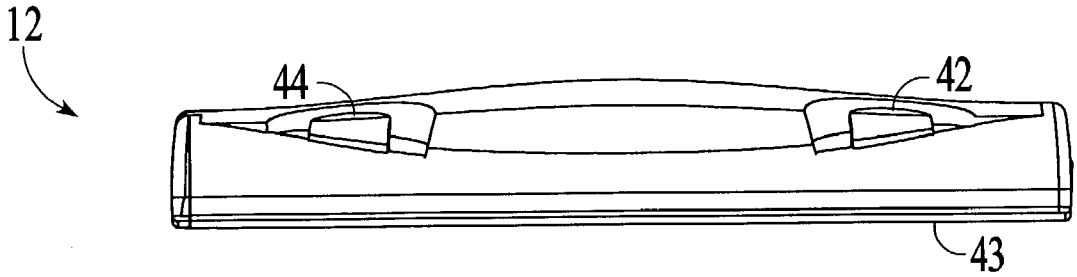
Figure 6C:
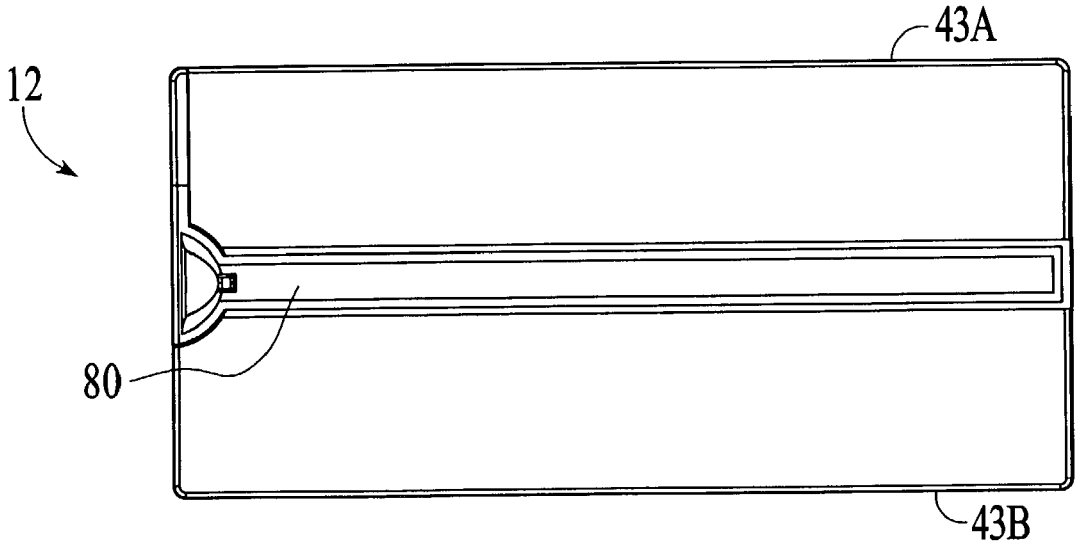

FIGS. 6A, 6B, and 6C are additional views of cleaning head assembly 12 that includes stays 42, 42, and 44, 44. As shown in FIG. 6B, which is a front view of the head assembly 12, the lower surface 43 of cleaning head assembly 12 is preferably substantially planar to match the contour of most surfaces to be cleaned. In one embodiment, as shown in FIG. 6B, the lower surface of the cleaning head assembly has a slight convex-shaped contour so that the two longitudinal edges 43A, 43B of the cleaning head surface are not touching the surface to be cleaned. Rather, these two edges are approximately 2.5 mm to 25 mm off the surface. Less dirt and other debris will load along the longitudinal edges 43A, 43B which would otherwise create additional friction as the cleaning head is moved when in use. The convex-shaped surface design allows for optimization pad use so that dirt and other debris accumulates more evenly over the entire cleaning surface of the pad.

In a preferred embodiment as illustrated in FIG. 6C, the bottom face or plate of cleaning head assembly 12 is provided with a groove or channel 80, into which will nest a holdfast for the cleaning pad, or, more preferably, a rake or other abradent tool.

The cleaning pad is preferably fabricated of absorbent and/or absorbent materials. The cleaning pad can be made of nonwoven material such as nonwoven, fibrous sheet materials or meltblown, coform, air-laid, spun bond, wet laid, bonded-carded web materials, and/or hydroentangled (also known as spunlaced) materials. The cleaning pad can also be made of woven materials such as cotton fibers, cotton/nylon blends and/or other textiles. The cleaning pad can also include wood pulp, a blend of wood pulp, and/or synthetic fibers, e.g., polyester, RAYON, NYLON, polypropylene, polyethylene, and/or cellulose polymers.

Absorbent material can be constructed as part of a single or multiple layered cleaning pad attached in either the wet or dry state to the end of the cleaning head. The cleaning pads will preferably have an absorbent capacity, when measured under a confining pressure of 0.09 psig after 20 minutes, of at least about 1 g deionized water per g of the cleaning pad, preferably at least about 10 g deionized water per g of the cleaning pad.

The cleaning pad can be textured, e.g., having a scrim structure, to provide an abrasive surface that is useful for scrubbing. The texture may be part of a cover layer that is attached to an absorbent core. The cleaning pad should be sufficiently durable for sustained use and reuse after wash. Typically, consumers will simply replace the soiled cleaning pad with a new one. Alternative cleaning pad designs and materials are described in U.S. Pat. No. 6,540,424 to Hall et al., which is incorporated herein by reference.

The cleaning pad may have two functional sides. Both sides may be identical in terms of materials and design, e.g., texture, or each side can be fabricated differently for a particular cleaning activity. These cleaning activities may include, for instance, wet cleaning, dry cleaning, particle pick-up, hair pick-up, carpet cleaning, hard surface cleaning, window cleaning, scrubbing, liquid pick-up, and streak-free drying.

Another feature of the cleaning pads is that they can be fabricated to enhance a consumer's cleaning experience in terms of ease of use and effectiveness. For example, by appropriate design and/or selection of materials, the surface friction of the cleaning pad can be minimized, as measured when the pad is pushed across the surface to be cleaned without diminishing cleaning performance. This "glide" phenomenon can be achieved, for example, by forming a laminated netting on at least a portion of the cleaning pad. The laminated netting can be overlaid, stamped, or embossed onto the cleaning pad surface. This laminated netting may consist of equivalent crossed filaments, or the filaments in the forward movement direction may be thicker or non-circular. This technique is further described in U.S. patent application 2002065012 to Takabayashi et al. which is incorporated herein by reference.

In one embodiment, the cleaning device is characterized by a specific glide resistance or force as the cleaning head assembly is moved over a surface to be cleaned, e.g, carpet areas, with a minimum of human exertion while effectively agitating the carpet surface. The glide force is measured with an Imada 50 pound push/pull force gauge with the mop head that is attached in a holder having a combined weight (mop head plus holder) of 17 pounds. The mop head is moved across a 12 in.×12 in. (305 mm×305 mm) carpet sample (32.5 oz/sq yard face weight, ⅛ in. (3.2 mm) gauge, staple, NYLON 6-6 with a 2-ply heat set pile in Saxony style) with the cleaning pad, bristles, or both cleaning pad and bristles in contact with the carpet sample.

For a cleaning head assembly having a pad attached thereto, the characteristic glide force is preferably about 4 to 20 pounds of force, and more preferably about 6 to 15 pounds of force. For a cleaning head assembly having bristles only, the glide force is preferably about 10 to 30 pounds of force, and more preferably about 12 to 18 pounds of force. Finally, for a cleaning head assembly that is equipped with both a pad and bristles, the glide force is preferably about 15 to 40 pounds of force, and more preferably about 15 to 30 pounds of force. Using the glide test described above, cleaning head assembly equipped with bristles as illustrated in FIGS. 13A–13D yielded glide forces of 10.3, 12.3, 15.7, and 20.6, respectively.

Another technique to reduce surface friction is to elevate at least a part of the cleaning pad surface relative to the surface to be cleaned, which may be appropriate where the surface to be cleaned is a thick "shag" type rug which normally impedes the movement of the cleaning pad. For example, to increase maneuverability the cleaning head assembly's lower surface can be permanently or adjustably raised with wheels, ball bearings, and/or other roller means that are mounted on the cleaning head assembly.

In the case where the cleaning pads are made of an absorbent material, the cleaning composition may include an effective amount of release agent to increase the amount of cleaning components, e.g., polymeric stain removing agents, released from the cleaning pad and onto the surface to be cleaned. The release agent is preferably an ionic species designed to compete with the polymer for sites on the cleaning pad thereby causing increased polymer release from the cleaning pad during use. The release agent may include a salt. A variety of different salts can be used such as, for example, monovalent salts, divalent salts, organic salts, and the like. Preferably, the effective ionic strength of the release agent in the cleaning composition is at least about $5\times10^{-3}$ mol/l.

A variety of chemical adjuncts/additives may be incorporated into the pad itself. These additives may be sprayed on or otherwise applied. They may be incorporated as part of the fiber materials. They may be encapsulated or imbedded in the pad materials, for example, as described in WO2002102331 to Alwattari et al. The cleaning pad may have optional additives on the pad, which either interact with the cleaning formula or transfer to the surface to be cleaned. These optional additives may include, for instance, miticide and anti-allergen agents, soil and stain resist agents, abrasives, antifoam agents, lubricants to enhance glide, dirt attracting polymers, odor absorbing agents, and/or wetting agents, which are further described herein.

The adjuncts/additives that are incorporated directly into the cleaning pad prior to use or indirectly as part of the cleaning composition during use can be encapsulated for delayed effect. For example, fragrance that is encapsulated and deposited on the carpet becomes "activated" when the capsules are broken by mechanical action e.g., friction from foot traffic, or dissolved by chemical means, e.g., oxidation or light triggered. As another example, encapsulated peroxide can be used for sustained release on the carpet surface. The capsules can be formulated to activate on contact with water from the soil. This ensures that oxidation and soil breakdown start on contact with the carpet surface.

Encapsulation can be accomplished by coating the adjunct with the appropriate materials. Typically, the coating material will comprise polymeric materials.

D. Canister Design

The cleaning composition is preferably stored in and dispensed from a pressurized, corrosion resistant canister or cleaning fluid container that is equipped with a nozzle so that an aerosol or spray of the composition can be readily applied to a surface as a relatively uniform layer of foam. As used herein, the terms "aerosol" and "spray" denote a suspension of fine solid or liquid particles. Suitable aerosol canisters or dispensers include a sealed chamber where cleaning fluid and propellant are stored and a hollow stem or tube having a distal end located within the chamber and a proximal end outside. The proximal end is connected to nozzle with an orifice appropriately dimensioned to create a fan-shaped spray pattern. Flow of cleaning fluid and propellant through the stem is regulated by a valve that is typically pressure activated. A suitable nozzle comprises a vertical valve having a rectangular orifice with dimensions of 0.010 in. (0.254 mm)×0.031 in. (0.787 mm) that is manufactured by Summit Packaging System, Inc., Manchester, N.H. Aerosol dispensers are well known in the art. Although pressure within the dispenser does not appear to be critical, a preferred range is about 40 to 58 lb./in.$^2$ more preferably 40 to 50 lb./in.$^2$ and most preferably 40 to 47 lb./in.$^2$ at 70° F. (21° C.).

The aerosol dispensers are constructed of conventional materials. The dispenser should be capable of withstanding internal pressure in the range of from about 20 to about 110 psig and more preferably from about 20 to about 70 psig. The dispenser dispenses the carpet cleaning composition as a spray of very fine, or finely divided, particles or droplets, which is defined as "foam." See also, D. J. Durian, "Foams," *Kirk-Othmer Encyclopedia of Chemical Technology* (1994).

The aerosol dispenser is pressurized with a gaseous component that is generally known as a propellant. Common aerosol propellants, e.g., gaseous hydrocarbons such as isobutane, and mixed halogenated hydrocarbons, can be used. Halogenated hydrocarbon propellants such as chlorofluoro hydrocarbons have been alleged to contribute to environmental problems, and are not preferred. When cyclodextrin is present in the carpet cleaning composition for odor control reasons, hydrocarbon propellants are not preferred, because they can form complexes with the cyclodextrin molecules thereby reducing the availability of uncomplexed cyclodextrin molecules for odor absorption. Preferred propellants are compressed air, nitrogen, carbon dioxide, and other inert gases. Commercially available aerosol-spray dispensers are further described in U.S. Pat. No. 3,436,772 to Stebbins and U.S. Pat. No. 3,600,325 to Kaufman et al., both of which are incorporated herein by reference.

Another type of aerosol dispenser that may be employed includes a barrier that separates the cleaning composition from the propellant, e.g., compressed air or nitrogen, which is further described in U.S. Pat. No. 4,260,110 to Werding and incorporated herein by reference. Such a dispenser is available from EP Spray Systems, East Hanover, N.J.

Alternatively, the aerosol spray dispenser can be a self-pressurized non-propellant container having a convoluted liner and an elastomeric sleeve. These self-pressurized dispensers employ a liner/sleeve assembly containing a thin, flexible radially expandable convoluted plastic liner, which is about 0.010 in. (0.254 mm) to about 0.020 in. (0.508 mm) thick, inside an essentially cylindrical elastomeric sleeve. The liner/sleeve is capable of holding a substantial quantity of cleaning composition product and of causing the product to be dispensed. Suitable self-pressurized spray dispensers are further described in U.S. Pat. Nos. 5,111,971 and 5,232,126 both to Winer and which are herein incorporated by reference.

E. Valve Actuator and Cap

Another feature of the cleaning implement is that the canister includes an overcap or cap for self-alignment of the canister nozzle to an opening in the canister holster or cradle. The cap also affords protection against inadvertent discharge during storage or non-use. For purposes of illustrating the aerosol actuator and cap, it is assumed that the aerosol dispenser used is a conventional one that includes a canister, which is filled with a cleaning composition and a propellant, and a nozzle. The flow through the nozzle is controlled by a valve that is activated, i.e., opened, when the valve's actuator or actuator button is pressed.

Figure 7A:
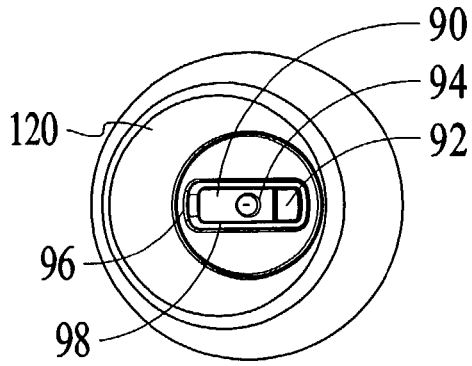
FIGS. 7A, 7B, 7C, 7D, and 7E are the top plan, bottom plan, top perspective, bottom perspective, and side views, respectively, of the canister overcap of the cleaning implement.
Figure 7B:
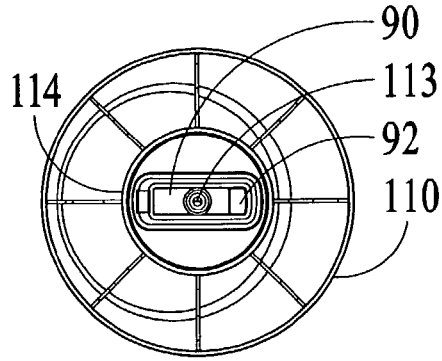
Figure 7C:
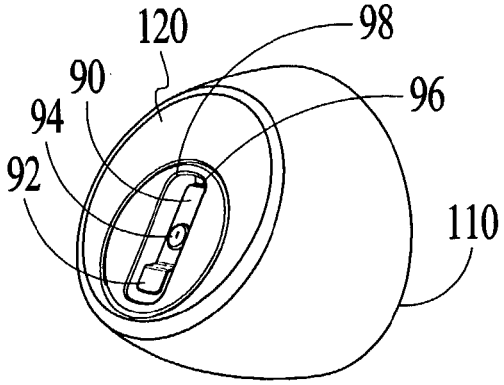
Figure 7D:
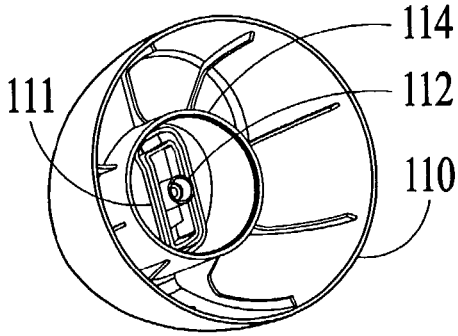

As shown in FIGS. 7A through 7E, the cap has a cylindrical base 110 with a diameter sized to be frictionally engaged to the upper rim of a cylindrical canister. As illustrated in FIGS. 7A and 7C, the upper slanted surface 120 of the cap defines an elongated recess 98 in which a pivotally hinged valve actuator arm 90 is positioned. Specifically, valve actuator arm 90 defines the front surface 94 of the nozzle with its orifice. In the fashion, when a force is applied valve actuator arm 90 will engage the valve in the canister which will then release the cleaning fluid. As shown in FIGS. 7B and 7D, the inner surface of the cap includes an inner annular ridge 114 surrounding the interior surface 111 of recess 98. Situated at the center is a nozzle socket 112 which an orifice 113. This nozzle socket 112 effectively mates with the tapered distal end 142 of hollow stem 144 when the cap is attached to the canister as shown in FIG. 3D. Cleaning composition exits orifice 113 of nozzle socket 112. The cap is preferably fabricated by conventional molding techniques as a single piece, i.e., integral unit.

The canister is preferably locked into the cradle by means of a latch mechanism on the internal passage of the cradle as described previously. The latch mechanism preferably requires 7 to 10 lbs of force to overcome in order to remove the canister once the latter becomes properly positioned in the cradle. The latch mechanism preferably has an audible, physical, visual or other consumer clue indicating clear engagement. Preferably, pushing the aerosol can into engagement position or pulling the same out of the engagement position gives an audible clue of 5 to 20 decibels.

Figure 7E:
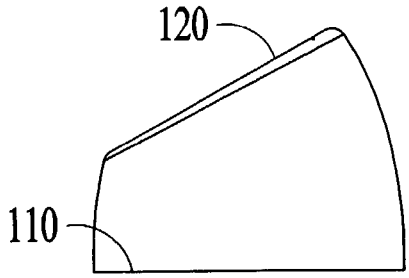

The cap is designed so that when it is fitted onto a canister, the cap will help orient the canister within the cradle of the cleaning implement so that the nozzle will be properly aligned with the aperture in the cradle and the nozzle arm will also be properly aligned with the activation arm. This allows the user to quickly replace discharged dispensers by simply inserting the capped dispenser into the cradle. As shown in FIG. 7E, the upper surface 120 of the cap is slanted relative to the plane defined by its horizontal base 110. Preferably the angle of the slanted upper surface relative to its base ranges from 20 to 40 degrees, and more preferably from 26 to 32 degrees. Furthermore, the aerosol cap is not straight-walled; its outer surface decreases in circumference as it extends from its base 110. By shaping the interior of the cradle to have a contour matching that of the outer surface of the cap, the cap will align itself as it is inserted into the cradle.

The liquid cleaner is preferably dispensed in a reverse conical pattern, with the cleaner being emitted from the nozzle as a stream that broadens as it moves away from the orifice of the nozzle as illustrated in FIGS. 9 and 10. The nozzle orifice may be tilted at an angle of 2 to 35 degrees, preferably tilted at an angle of 10 to 30 degrees, and more preferably tilted at an angle of 15 to 25 degrees relative to the vertical centerline of the canister as illustrated in FIG. 3B. Referring to FIGS. 9 and 10, the nozzle may yield a fan shaped spray with spray angle of spray of 45 to 90 degrees and preferably of 60 to 80 degrees as measured from the top of the spray pattern to the surface being cleaned.

The nozzle is preferably positioned from 2 in. (50.8 mm) to 6 in. (152.4 mm) and preferably from 3 in. (76.2 mm) to 4 in. (101.6 mm) from the bottom of the cleaning head as measured when the pole is in its most upright position. The overall result as shown in FIGS. 9 and 10 is that the enclosing angle between the lower and upper spray pattern typically ranges from about 10 degrees to 30 degrees and preferably about 22 degrees.

F. Rake Brush and Swingarm

Particularly for cleaning carpets, the cleaning implement can include a rake brush that is positioned on the lower surface of the cleaning head assembly. By "rake brush" is meant any projection including, but not limited to, a teeth-shaped projection, bristle, mounds, prong, and the like, that is sufficiently stiff and dimensioned to interact with carpet fibers to loosen soil, dirt and other debris from the fibers. The projections of the rake brush will be collectively referred to herein as "bristles."

As further described herein, the bristles are preferably attached to a surface of a rake brush that is attached to the cleaning head. However, in another embodiment, the bristles can be permanently attached to a lower surface of the cleaning head. When a cleaning pad is attached to this lower surface, the bristles will pierce through the material. Alternatively, the pad can be fabricated with one or more openings through which the bristles project without piercing the fabric. Alternately, projections in the cleaning head may cause corresponding projections in the cleaning pad without piercing the fabric.

The materials loosen by the bristles will rise to the surface of the carpet where they can be readily removed. In addition, the bristles help integrate the cleaning composition, which may be present as a foam layer, into the carpet. Finally, the bristles will untangle carpet fibers to give the carpet a fresh, vacuumed appearance. As is apparent, the density and size of the bristles influence the glide force needed to maneuver the cleaning implement over the surface to be cleaned.

Generally the bristles may be from 0.05 in. (1.27 mm) to 0.5 in. (12.7 mm) in height, and the bristles may be from 0.04 in. (1.0 mm) to 0.08 in. (2.0 mm) in diameter. The bristles may be spaced apart by a distance of from 0.1 in. (2.5 mm) to 0.3 in. (7.6 mm). The bristles may be made of any suitable material, but relatively elastic materials, such as polypropylene, low density polyethylene, PET, PBT, PTT, and elastomers, such as silicone or butyl rubber, are preferred.

Figure 11:
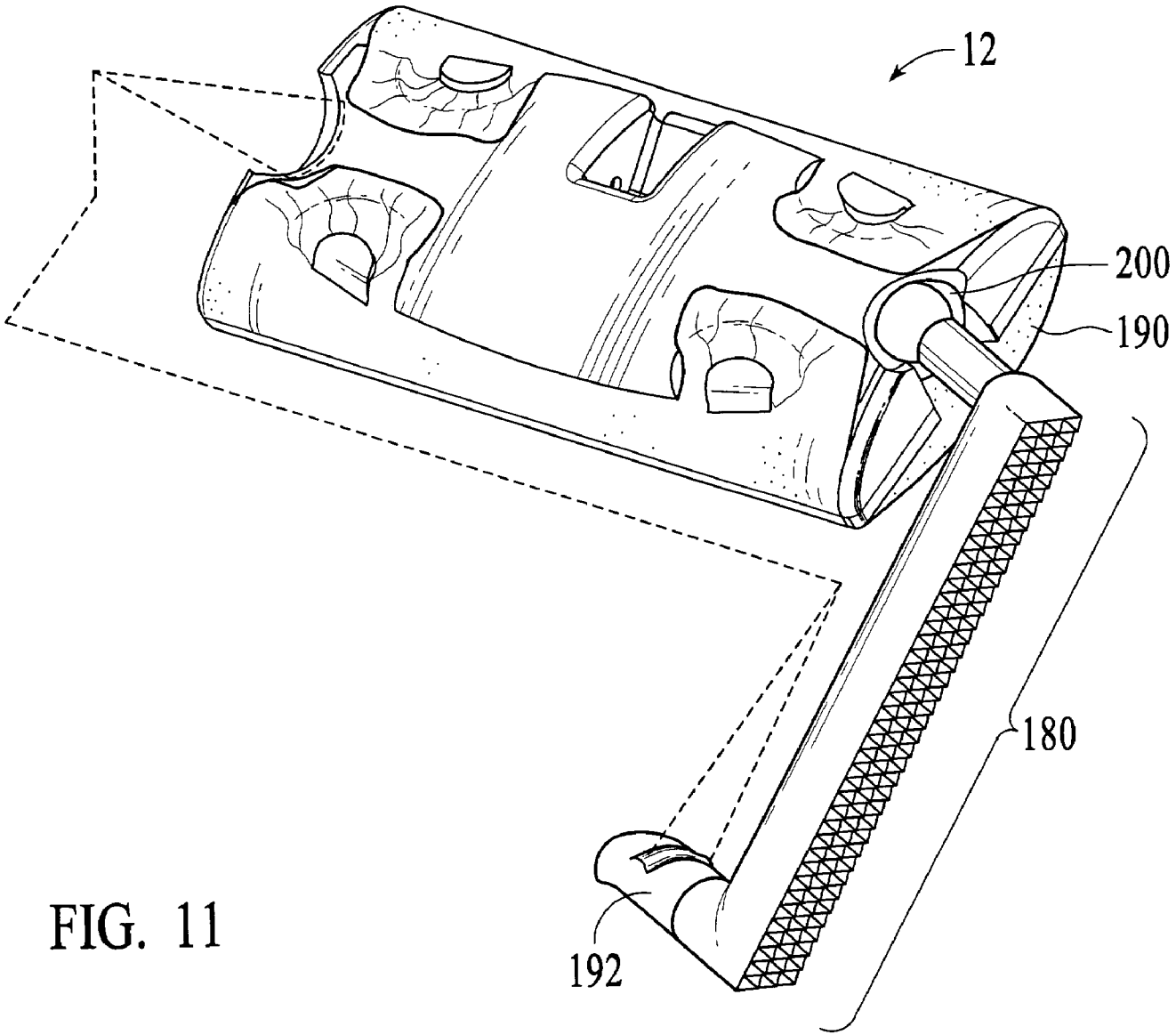
FIGS. 11 and 12A, 12B and 12C depict attachment devices for the rake.

FIG. 11 illustrates an embodiment of the rake brush 180 which is configured as part of a swingarm that is pivotally attached to the cleaning head 12 which has cleaning pad 190 secured to its lower surface. Specifically, one end of the swing-arm has a ball joint 200 that is attached to a socket that is located on a side of the cleaning head assembly. The other end 192 of the swingarm can be removably latched to a notch on the side opposite the socket. In this embodiment, the bristles would be located across the center of the lower surface of the cleaning head assembly. As is apparent, the detachable swingarm can be readily detached to permit the user to replace a soiled cleaning pad. In use, the swingarm is securely fastened to the cleaning head assembly so that the bristles remain rigid as the bristles comb through the carpet fibers.

For use for with this swingarm attachment, the cleaning pad should include side cut-out regions 53, 55 as illustrated in FIG. 5. The contours of the cut-out regions should be designed so the cleaning pad material does not cover either the socket or notch portions of the cleaning head assembly.

Figure 12A:
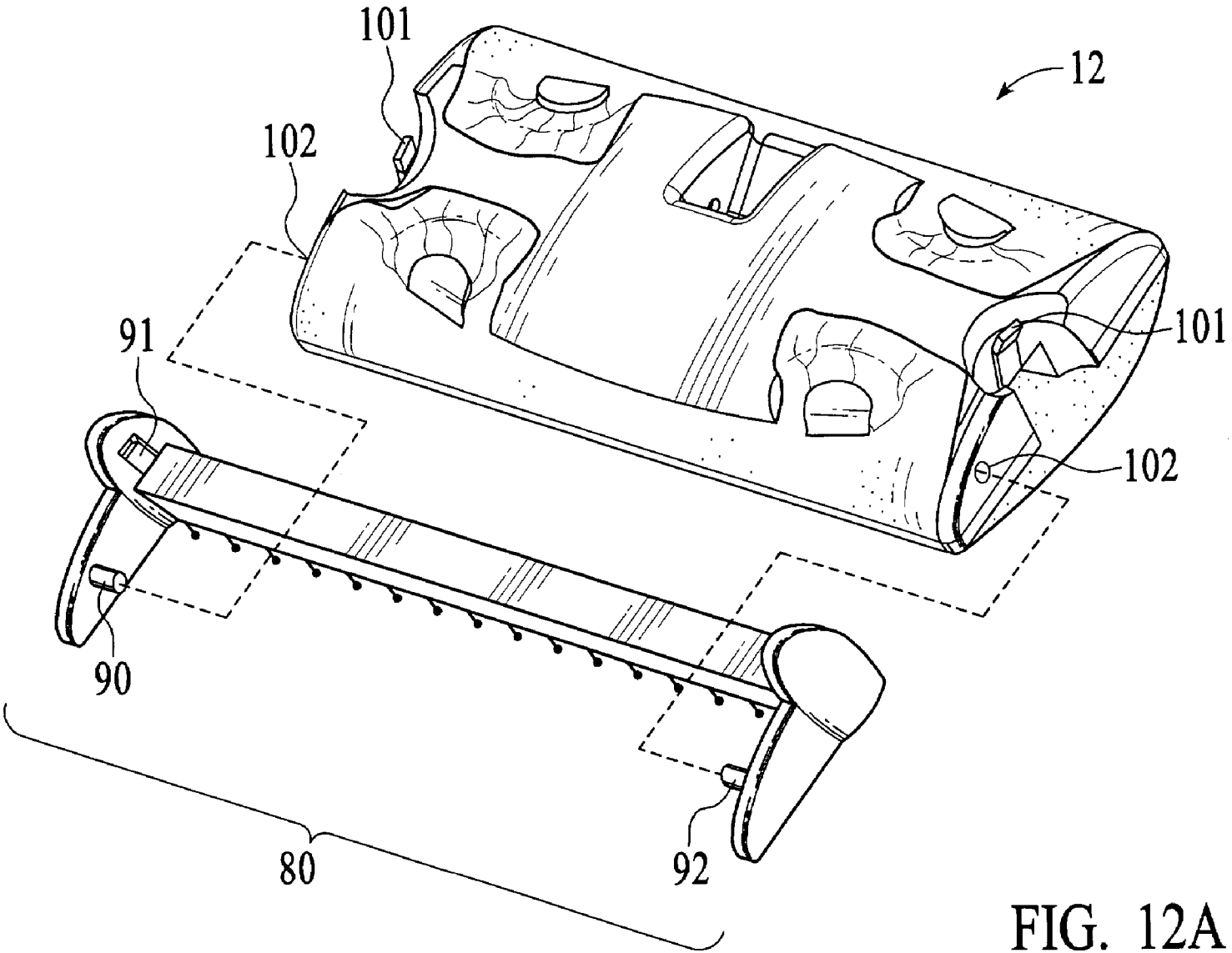

FIG. 12A shows another embodiment of a rake brush that is detachable to cleaning head assembly 12. The rake brush 80 is configured as a completely removable comb-like attachment that positions the bristles toward the front lower surface of the cleaning head assembly. The flexible comb attachment includes (i) dowels or posts 90, 92 which fit into corresponding holes 102 located on the sides of the cleaning assembly and (ii) locking ports 91 into which corresponding catches 101 on the cleaning assembly fit.

Figure 12B:
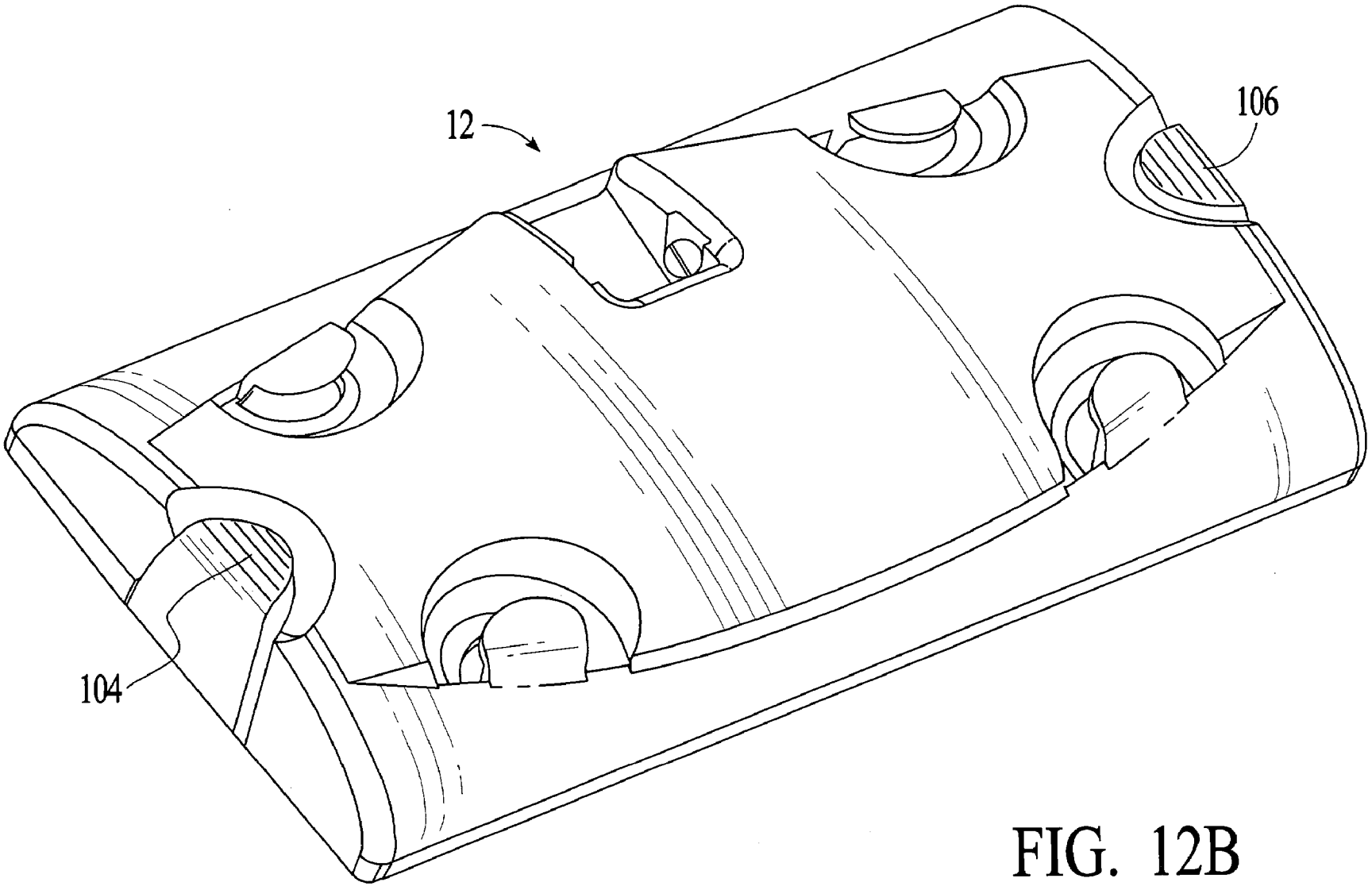

FIG. 12B shows the upper surface of the cleaning head assembly with the flexible comb attachment being attached thereto. To detach the comb, the consumer simply pushes arms 104, 106 away from the center of the cleaning assembly so that catches 101 disengage from locking ports 91.

Figure 12C:
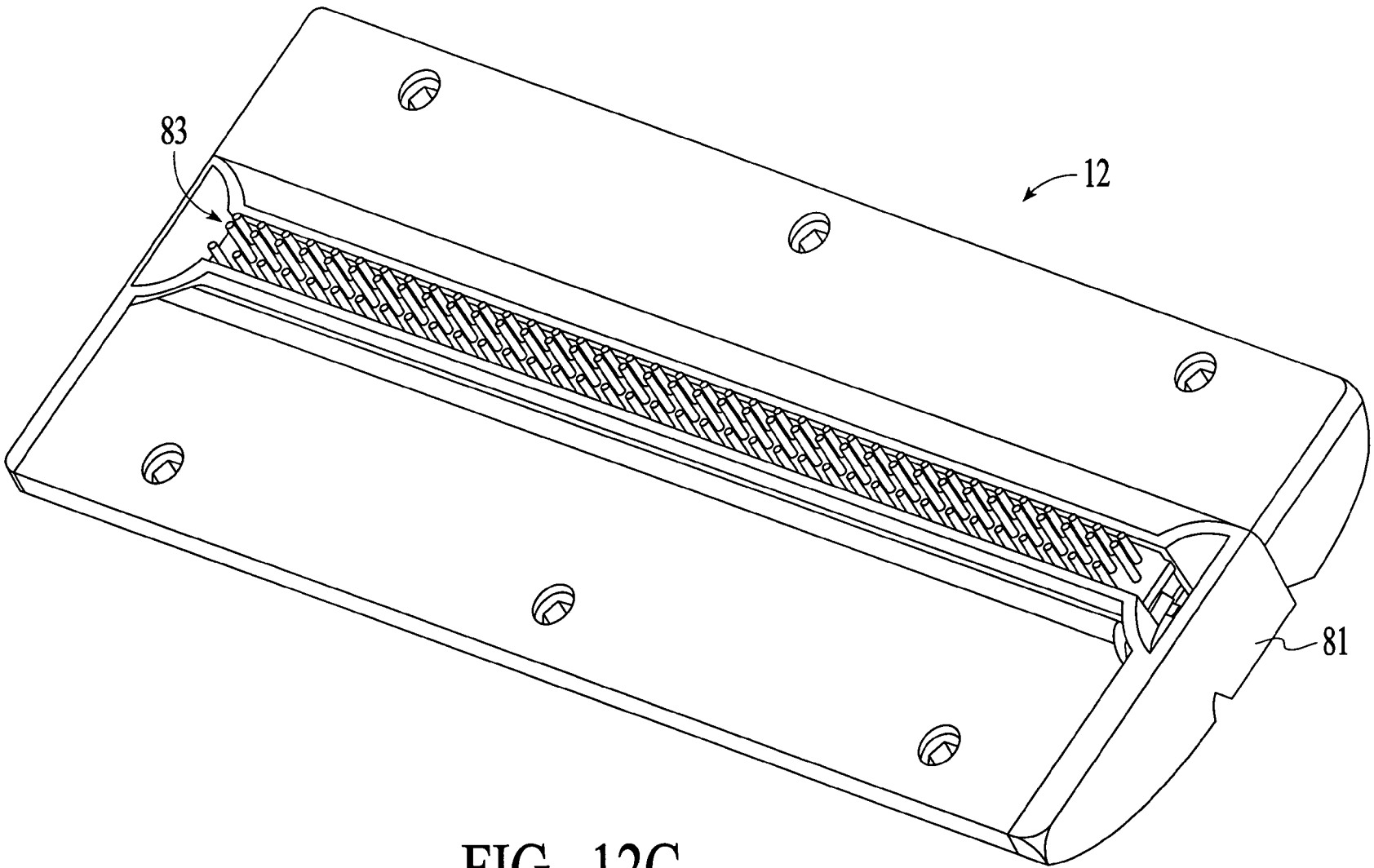

FIG. 12C shows the lower portion of the cleaning head assembly 12 also with a flexible comb attachment 81 being attached thereto. However, as is apparent the bristles 83 on this rake brush are different from those of rake brush 80 of FIG. 12A as further described herein. The comb attachment 81 is positioned within a groove that is formed within and along the middle part of the lower surface of the cleaning head assembly 12. FIG. 12C illustrates the cleaning head assembly without a cleaning pad. A pad can be attached to the cleaning head by first removing the rake brush, next securing the cleaning pad to the cleaning head assembly 12, and then reattaching the rake brush. The bristles of the rake brush are flanked by the cleaning pad located on both sides. The rake brush is preferably configured so that, when the cleaning pad has been attached, the surface of the rake brush from which the bristles are attached is substantially planar with the surface of the cleaning pad. In this fashion, when the lower surface of the cleaning head assembly is viewed from the front side, the bristles appear to protrude from the plane of the rake brush and cleaning pad surface.

The bristles 83 on rake brush 81 as illustrated in FIG. 12C are designed particularly for cleaning carpets. The rake brush has three rows of bristles, with the middle row bristles being about 0.35 in. (8.9 mm) in height and the two side row bristles being about 0.30 in. (7.6 mm) in height. The longer middle bristles are more flexible. When cleaning a large moderately soiled carpet area, it is desirable to have the cleaning head easy to push. In this scenario, the user would not push down on the clean heading as hard and only the taller, more flexible middle row of bristles would be fully engaged in the carpet. The user does not have to exert much energy to push the cleaning head over a large area. In contrast, for cleaning spots and stains, the user will tend to push harder thereby engaging the two outer rows of bristles as well. These shorter bristles stiffer and will scrub better on spots and stains.

It is desirable for the rake brush to pick up large, loose carpet fibers and hairs, but not to be impeded by small carpet fibers. In this regard, the spacing for between bristles 83 is preferably between 0.15 in. (3.8 mm) and 0.18 in. (4.6 mm). Concomitantly, to assure that the cleaning head assembly creates an optimal amount of glide force so that the rake brush can comb through the fibers without excessive exertion on the part of the user, preferably the bristle has a diameter of about 0.06 in. (1.5 mm) and a height of 0.3 in. (7.6 mm) to 0.35 in. (8.9 mm).

Figure 13A:
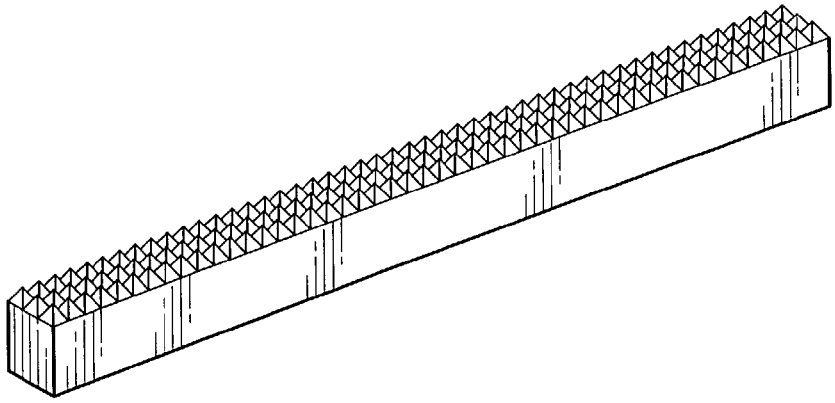
FIGS. 13A, 13B, 13C, and 13D depict alternative bristle designs.
Figure 13B:
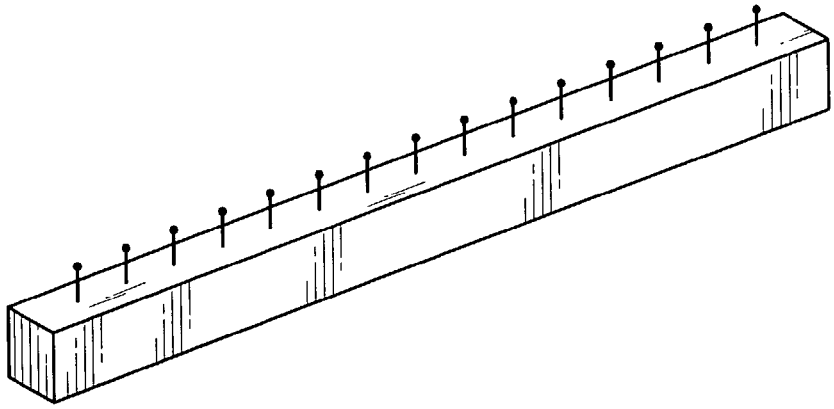
Figure 13C:
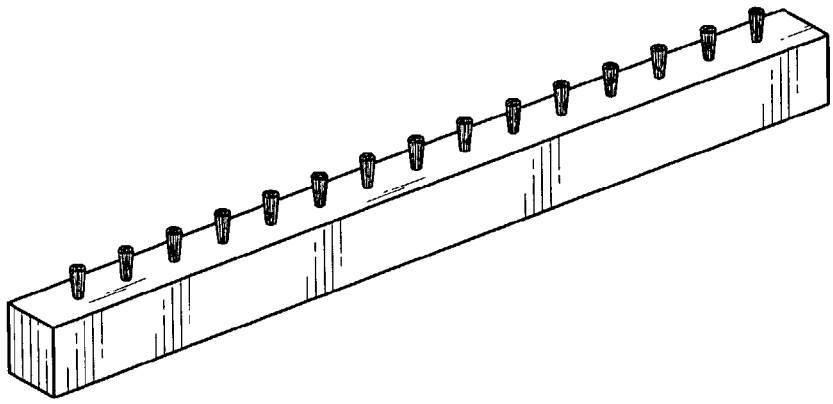
Figure 13D:
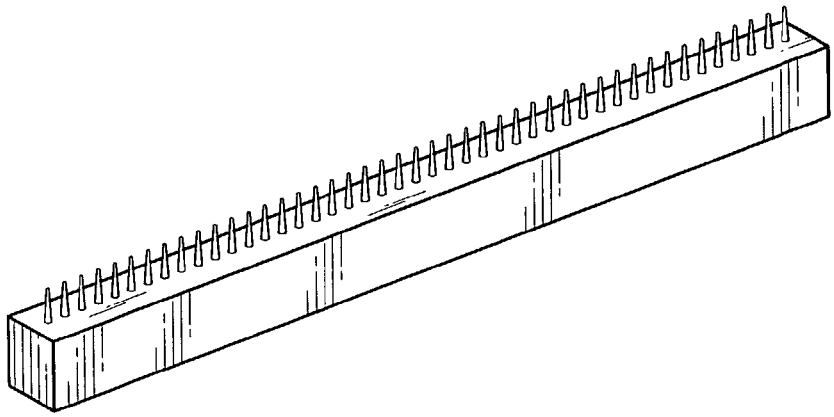

FIGS. 13A–13D, illustrates four different types bristles. FIG. 13A depicts bristles having beveled surfaces or quadrihedrons. FIG. 13B shows rounded comb heads mounted on posts. FIG. 13C depicts more stout brushes. FIG. 13D depicts sharper comb surfaces. As is apparent, a consumer can selected the appropriate rake for the surface to be cleaned.

Cleaning Composition

The aqueous cleaning composition described herein is particularly suited for cleaning carpets. It is understood that the choice of cleaning composition will depend on the surface to be cleaned. Water typically will be the predominant ingredient of the cleaning composition and in the formulation that is mixed with the propellant before being filled into the canister, water should be present at a level of less than 99%, more preferably less than about 96%, and most preferably, less than about 93% of the cleaning composition. As is apparent, concentrated forms of the cleaning composition can have significantly less water.

Preferred cleaning compositions include the following formulations set forth in Tables 1, 2 and 3. The percentages set forth herein relate to the cleaning formulations that are mixed with the propellant. Concentrated forms of the cleaning composition that can be diluted prior to use will have higher levels of the components.

TABLE 1

| | Fragranced | | Unfragranced | |
|---|---|---|---|---|
| Materials | Wt % | Wt(g) | Wt % | Wt(g) |
| DI Water (50,000 ohm) | 89.64 | 896.40 | 89.79 | 897.90 |
| DPnP (1) | 8.00 | 80.00 | 8.00 | 80.00 |
| STAPANOL WAC (29%) | 1.00 | 10.00 | 1.00 | 10.00 |
| Sodium Borate (Decahydrate) | 0.60 | 6.00 | 0.60 | 6.00 |
| ZELAN 338 | 0.20 | 2.00 | 0.20 | 2.00 |
| Sodium Benzoate | 0.25 | 2.50 | 0.25 | 2.50 |
| Sodium Metasilicate | 0.06 | 0.60 | 0.06 | 0.60 |
| Ammonium Hydroxide (28%) | 0.10 | 1.00 | 0.10 | 1.00 |
| Fragrance (IFF 6489 HBF) | 0.15 | 1.50 | 0.00 | 0.00 |
| Total | 100.00 | 1000.00 | 100.00 | 1000.00 |

(1) di(propylene glycol) n-propyl ether

TABLE 2

| | Fragranced | | Unfragranced | |
|---|---|---|---|---|
| Materials | Wt % | Wt(g) | Wt % | Wt(g) |
| DI Water (50,000 ohm) | 88.94 | 889.40 | 89.09 | 890.90 |
| Hexyl Cellosolve | 0.50 | 5.00 | 0.50 | 5.00 |
| DPnP | 7.00 | 70.00 | 7.00 | 70.00 |
| STEPANOL WAC (29%) | 1.00 | 10.00 | 1.00 | 10.00 |
| Sodium Borate (Decahydrate) | 0.60 | 6.00 | 0.60 | 6.00 |
| ZELAN 338 | 0.20 | 2.00 | 0.20 | 2.00 |
| RS25 (25%) (2) | 1.20 | 12.00 | 1.20 | 12.00 |
| Sodium Benzoate | 0.25 | 2.50 | 0.25 | 2.50 |
| Sodium Metasilicate | 0.06 | 0.60 | 0.06 | 0.60 |
| Ammonium Hydroxide (28%) | 0.10 | 1.00 | 0.10 | 1.00 |
| Fragrance (IFF 6489 HBF) | 0.15 | 1.50 | 0.00 | 0.00 |
| Total | 100.00 | 1000.00 | 100.00 | 1000.00 |

(2) RHODATERGE RS 25 from RhonePoulene

TABLE 3

| | Fragranced | | Unfragranced | |
|---|---|---|---|---|
| Materials | Wt % | Wt(g) | Wt % | Wt(g) |
| DI Water (50,000 ohm) | 89.54 | 895.40 | 89.69 | 896.90 |
| Hexyl Cellosolve | 1.00 | 10.00 | 1.00 | 10.00 |
| DPnP | 7.00 | 70.00 | 7.00 | 70.00 |
| STEPANOL WAC (29%) | 1.00 | 10.00 | 1.00 | 10.00 |
| Sodium Borate (Decahydrate) | 0.60 | 6.00 | 0.60 | 6.00 |
| ZELAN 338 | 0.20 | 2.00 | 0.20 | 2.00 |
| DC Q2-5111 (3) | 0.10 | 1.00 | 0.10 | 1.00 |
| Sodium Benzoate | 0.25 | 2.50 | 0.25 | 2.50 |
| Sodium Metasilicate | 0.06 | 0.60 | 0.06 | 0.60 |
| Ammonium Hydroxide (28%) | 0.10 | 1.00 | 0.10 | 1.00 |
| Fragrance (IFF 6489 HBF) | 0.15 | 1.50 | 0.00 | 0.00 |
| Total | 100.00 | 1000.00 | 100.00 | 1000.00 |

(3) Dow Corning

The cleaning composition may comprise additional and/or other components from the following listing. As noted above, some of the components can be incorporated into the cleaning pad.

A. Surfactant

The cleaning composition preferably contains one or more surfactants selected from anionic, nonionic, cationic, ampholytic, amphoteric and zwitterionic surfactants and mixtures thereof. Surfactants, among other things, aid in the removal of soil from carpets. Suitable anionic, nonionic, ampholytic, and zwitterionic surfactants are disclosed in U.S. Pat. No. 3,929,678 to Laughlin and in Heuring, *Surface Active Agents and Detergents,* Vol. I by Schwartz, Perry and Berch; suitable cationic surfactants are disclosed in U.S. Pat. No. 4,259,217 to Murphy. Where present, ampholytic, amphotenic and zwitteronic surfactants are generally used in combination with one or more anionic and/or nonionic surfactants. The surfactants are preferably present at a level of from 0.01% to 5% and preferably from 0.1% to 1% of the composition. (All percentages herein are based on weight unless otherwise noted.)

In preferred cleaning compositions, an anionic surfactant useful for detersive purposes can be added. These can include salts (including, for example, sodium, potassium, ammonium, and substituted ammonium salts such as mono-, di- and triiethanolamine salts) of the anionic sulfate, sulfonate, carboxylate and sarcosinate surfactants. Anionic sulfate and sulfonate surfactants are preferred. The anionic surfactants is preferably present at a level of from 0.1% to 60%, more preferably from 1 to 40%, and most preferably from 5% to 30%. Preferred are surfactants systems comprising a sulfonate and a sulfate surfactant, preferably a linear or branched alkyl benzene sulfonate and alkyl ethoxylsulfates, as described herein.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl)glucamine sulfates, and sulfates of alkylpolysacchanides such as the sulfates of alkylpo lygluco side (the nonionic nonsulfated compounds being described herein). Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_1$–$C_{18}$, most preferably $C_{11}$–$C_{15}$ alkyl sulfate which has been ethoxylated with from 0.5 to 7, preferably from 1 to 5, moles of ethylene oxide per molecule. A particularly preferred aspect of the invention employs mixtures of the preferred alkyl sulfate and/or sulfonate and alkyl ethoxysulfate surfactants. Such mixtures are disclosed in WO 93/18124.

Anionic sulfonate surfactants suitable for use herein also include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof. Suitable anionic carboxylate surfactants include the alkyl ethoxy carboxylates, the alkyl polyethoxy polycarboxylate surfactants and the soaps ('alkyl carboxyls'), especially certain secondary soaps as described herein. Suitable alkyl ethoxy carboxylates include those with the formula $RO(CH_2CH_2O)_xCH_2C00^{-M+}$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxypolycarboxylate surfactants include those having the formula RO—(CHR$^1$—CHR$^2$—O)—R$^3$ wherein R is a $C_6$ to $C_{18}$ alkyl group, x is from 1 to 25, R$^1$ and R$^2$ are selected from the group consisting of hydrogen, methyl acid radical, succinic acid radical, hydroxysuccinic acid radical, and mixtures thereof, and R$^3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Other suitable anionic surfactants are the alkali metal sarcosinates of formula R—CON (R$^1$)CH COOM, wherein R is a $C_5$–$C_{17}$ linear or branched alkyl or alkenyl group, R$^1$ is a $C_1$–$C_4$ alkyl group and M is an alkali metal ion. Preferred examples are the myristyl and oleoyl methyl sarcosinates in the form of their sodium salts.

Essentially any alkoxylated nonionic surfactants can be employed. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

The condensation products of aliphatic alcohols with from 1 to 25 moles of alkylene oxide, particularly ethylene oxide and/or propylene oxide, are suitable. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Polyhydroxy fatty acid amides suitable for use are those having the structural formula $R^2CONR^1Z$ wherein: R$^1$ is H, $C_1$–$C_4$ hydrocarbyl, 2-hydroxyethyl, 2-hydroxypropyl, ethoxy, propoxy, or a mixture thereof, preferable $C_1$–$C_4$ alkyl, more preferably $C_1$ or $C_2$ alkyl, most preferably $C_1$ alkyl (i.e., methyl); and R$^2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof-, and Z is a polyhydroxyhydrocarbyl having a linear hydrocarbyl chain with at least 3 hydroxyls directly connected to the chain, or an alkoxylated derivative (preferably ethoxylated or propoxylated) thereof Z preferably will be derived from a reducing sugar in a reductive amination reaction; more preferably Z is a glycityl.

Suitable fatty acid amide surfactants include those having the formula: $R^1CON(R^2)_2$ wherein R$^1$ is an alkyl group containing from 7 to 21, preferably from 9 to 17 carbon atoms and each R$^2$ is selected from the group consisting of hydrogen, $C_1$–$C_4$ alkyl, $C_1$–$C_4$ hydroxyalkyl, and —$(C_2H_{40})_xH$, where x is in the range of from 1 to 3.

Suitable alkylpolysaccharides are disclosed in U.S. Pat. No. 4,565,647 to Llenado, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula: $R^2O(C_nH_{2n}O)_t(\text{glycosyl})_x$ wherein R$^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Suitable amphoteric surfactants include the amine oxide surfactants and the alkyl amphocarboxylic acids. Suitable amine oxides include those compounds having the formula $R^3(OR^4)_xNO(R^5)_2$ wherein R$^3$ is selected from an alkyl, hydroxyalkyl, acylamidopropoyl and alkyl phenyl group, or mixtures thereof, containing from 8 to 26 carbon atoms; R$^4$ is an alkylene or hydroxyalkylene group containing from 2 to 3 carbon atoms, or mixtures thereof, x is from 0 to 5, preferably from 0 to 3; and each R$^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10}$–$_{18}$ acylamido alkyl dimethylamine oxide. A suitable example of an alkyl aphodicarboxylic acid is MIRANOL $C_2M$ Conc. manufactured by Miranol, Inc., Dayton, N.J.

Zwitterionic surfactants can be broadly described as derivatives of secondary and tertiary amines, derivatives of heterocyclic secondary and tertiary amines, or derivatives of quaternary ammonium, quaternary phosphoniurn or tertiary sulfonium compounds. Betaine and sultaine surfactants are exemplary zwittenionic surfactants.

Suitable betaines are those compounds having the formula $R(R^1)_2N^+R^2COO^-$ wherein R is a $C_6$–$C_{18}$ hydrocarbyl. group, each R$^1$ is typically $C_1$–$C_3$ alkyl, and R$^2$ is a $C_1$–$C_5$ hydrocarbyl group. Preferred betaines are $C_{12}$–$C_{18}$ dimethyl-ammonio hexanoate and the $C_{10}$–$C_{18}$ acylamidopropane (or ethane) dimethyl (or diethyl) betaines. Complex betaine surfactants can also be used.

Suitable cationic surfactants include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred cationic surfactants include mono-alkoxylated and bis-alkoxylated amines.

Another suitable group of cationic surfactants are cationic ester surfactants. The cationic ester surfactant is a, preferably water dispersible, compound having surfactant properties comprising at least one ester (i.e., —COO—) linkage and at least one cationically charged group. Suitable cationic ester surfactants, including choline ester surfactants, have for example been disclosed in U.S. Pat. Nos. 4,228,042 and 4,260,529 both to Letton and U.S. Pat. No. 4,239,660 to Kingry.

The ester linkage and cationically charged group can be separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting, of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Other suitable surfactants are cationic mono-alkoxylated amine surfactants preferably of the general formula: $R^1R^2R^3N^+ApR^4X^-$ wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8. Preferably the $A_pR^4$ group in the formula has p=1 and is a hydroxyalkyl group, having no greater than 6 carbon atoms whereby the —OH group is separated from the quaternary ammonium nitrogen atom by no more than 3 carbon atoms. Particularly preferred $A_pR^4$ groups are —$CH_2CH_2$—OH, —$CH_2CH_2CH_2$—OH, —$CH_2CH(CH_3)$—OH and —CH$(CH_3)CH_2$—OH, with —$CH_2CH_2$—OH being particularly preferred. Preferred $R^1$ groups are linear alkyl groups. Linear $R^1$ groups having from 8 to 14 carbon atoms are preferred.

Another highly preferred cationic mono-alkoxylated amine surfactants have the formula $R^1(CH_3)(CH_3)N^+(CH_2CH_{20})_{2-5}H\ X^-$ wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_{2O}$) units (EO) are replaced by butoxy, isopropoxy [$CH(CH_3)CH_{2O}$] and [$CH_2CH(CH_3)O$] units (i-Pr) or n-propoxy units (Pr), or mixtures of EO and/or Pr and/or i-Pr units.

The level of the cationic mono-alkoxylated amine surfactants is preferably from 0.1% to 20%, more preferably from 0.2% to 7%, and most preferably from 0.3% to 3.0%.

The cationic bis-alkoxylated amine surfactant preferably has the general formula: $R^1R^2N^+ApR^3A'qR^4X^-$ wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants further include those of the formula $R^1CH3N^+(CH_2CH_2OH)(CH_2CH_2OH)\ X^-$ wherein $R^1$ is $C_{10}$–$C_{18}$ hydrocarbyl and mixtures thereof, preferably $C_{10}$, $C_{12}$, $C_{14}$ alkyl and mixtures thereof $X^-$ is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $A_pR^3$ and $A_pR^4$ are each monoethoxy.

Other useful cationic bis-alkoxylated amine surfactants include compounds of the formula: $R^1R^2N^+$—$(CH_2CH_2O)_pH$—$(CH_2CH_2HO)_qH\ X^-$ wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and $X^-$ is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3)O$] units (i-Pr) or n-propoxy units (Pr), or mixtures of EO and/or Pr and/or i-Pr units.

B. Solvent

The cleaning composition also includes organic solvents which solubilize hydrophobic materials as well as some of the cleaning components. The solvent is preferably present at a level of from 0.1% to 25% and preferably from 3 to 15% of the composition. Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water soluble solvent when employed.

C. Additional Adjuncts

The cleaning composition optionally contains one or more of the following adjuncts: stain blocking agents, stain and soil repellants, enzymes, lubricants, insecticides, miticides, anti-allergen agents, odor control agents, fragrances and fragrance release agents, brighteners or fluorescent whitening agents, oxidizing or reducing agents, polymers which leave a film to trap or adsorbs bacteria, virus, mite, allergens, dirt, dust, or oil.

The cleaning composition may includes additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermacet, candelilla, paraffin, lanolin, shellac, esparto, ouricuri, polyethylene wax, chlorinated naphthaline wax, petrolatu, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. DANTAGARD and/or GLYDANT) and/or short chain alcohols (e.g. ethanol and/or IPA).

The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenylphenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A. G.

E. Antimicrobial Agent

An antimicrobial agent can also be included in the cleaning composition. Non-limiting examples of useful quaternary compounds that function as antimicrobial agents include benzalkonium chlorides and/or substituted benzalkonium chlorides, di($C_6$–$C_{14}$)alkyl di short chain ($C_{14}$ alkyl and/or hydroxyalkl)quaternaryammonium salts, N-(3-chloroallyl)hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyldimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the low-surfactant compositions, range from about 0.001% to about 0.8% and preferably from about 0.005% to about 0.3% of the usage composition. The weight percentage ranges for the biguanide and/or quat compounds in the cleaning composition is selected to disinfect, sanitize, and/or sterilize most common household and industrial surfaces.

Non-quaternary biocides are also useful. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics.

These antimicrobial, antifungal or antiallergen materials include water-soluble, film-forming polymers (See, U.S. Pat. No. 6,454,876 to Ochomogo which is incorporated herein by reference), quaternary ammonium compounds and complexes therewith (See, U.S. Pat. Nos. 6,482,392, 6,080,387, 6,284,723, 6,270,754, 6,017,561 and 6,013,615 to Zhou et al. all of which are incorporated herein by reference), essential oils, such as nerolidol (See, U.S. Pat. No. 6,361,787 to Shaheen et al. incorporated by reference), KATHON (See, U.S. Pat. No. 5,789,364 to Sells et al., and U.S. Pat. No. 5,589,448 to Koerner et al., which are incorporated herein by reference), and, possibly, bleaches, such as hydrogen peroxide and alkali metal hypochlorite.

E. Corrosion Inhibitors

Since the canister to dispense the cleaning compostion in aerosol form can be made of metal, e.g., tin-plated steel can, it is advantageous to add one or more corrosion inhibitors to prevent or at least reduce the rate of expected corrosion of such a metallic dispenser. Chloride salts, if present, may cause corrosion. Preferred corrosion inhibitors include, for example, sodium nitrite, potassium nitrite, sodium benzoate, potassium benzoate, amine neutralized alkyl acid phosphates and nitroalkanes, amine neutralized alkyl acid phosphates and volatile amines, diethanolamides, amine borates, hydroxylamines, alkanolamines, amine carboxylates, esters, volatile silicones, amines and mixtures thereof. Specific inhibitors include, for example, sodium lauroyl sarcosinate, available from Stepan Company under the trademark MAPROSYL 30, sodium meta silicate, sodium or potassium benzoate, triethanolamine, and morpholine. When employed, the corrosion inhibitor preferably comprises about 0.01% to 5% of the aerosol formulation.

F. Miticide and Anti-allergen Agents

Optional miticides include boron compounds and salts, including boric acid, borates, octaborate, tetraborate, borax, and metaborate. Other optional miticides include benzylbenzoate, phenyl salicylate, diphenylamine, methyl p-naphthyl ketone, coumarin, phenethyl benzoate, benzyl salicylate, phenyl benzoate, N-fluorodichloromethylthiocyclohexene-dicarboxyimide, p-nitrobenzoic acid methyl ester, p-chlorometaxylenol, bromocinnamic aldehyde, 2,5-dichloro-4-bromophenol, N,N-dimethyl-N'-tryl-N'-(fluorodichloromethylthio)-sulfamide, 2-phenylphenol, sodium 2-phenylphenolate, 5-chloro-2-methyl-4-isothiazoline-3-one, 2-methyl-4-isothiazonoline-3-one, benzimidazolylmethyl-carbamate, the antimicrobials listed herein, and mixtures thereof.

Optional anti-allergen metal ions include metallic salts are selected from the group consisting of zinc, stannous, stannic, magnesium, calcium, manganese, titanium, iron, copper, nickel, and mixtures thereof. Other optional anti-allergen agents include polyphenol compounds including tannins, catechins, and gallic acid, hydrogen peroxide, salicylic acid, citric acid, lactic acid, glycolic acid, ascorbic acid, gluconic acid, pyruvic acid, glucaric acid, hydroxy benzoic acid, hydroxyglutamic acid, hydroxyphathalic acids, malic acid, and mixtures and salts thereof.

Film forming polymers can reduce allergens in the air. Suitable film-forming polymers include, water-soluble polymers selected from the group consisting of starch, polyvinyl alcohols, methyl cellulose and its derivatives, polyacrylic acids, polyethylene glycols with molecular weight higher than 5000, polyethylene, polypropylene glycol with molecular weight higher than 8000, Cosmetic Toiletry Fragrances Association polyquatemium compounds 1 through 14, polyvinyl pyrrolidone, and mixtures thereof. Specific examples of certain preferred film forming polymers are selected from the group consisting of hydroxy-propyl starch, DAISEL MC 1310, Kuraray poly vinyl alcohol 205, N-Polyvinyl-2 pyrrolidone, and mixtures thereof.

As used herein, the term "plant essential oil" or "plant essential oil compound" (which shall include derivatives thereof) generally refers to a monocyclic, carbocyclic ring structure having six-members and substituted by at least one oxygenated or hydroxyl functional moiety. Examples of plant essential oils encompassed within the present invention, include, but are not limited to, members selected from the group consisting of aldehyde $C_{16}$ (pure), a-terpineol, amyl cinnamic aldehyde, amyl salicylate, anisic aldehyde, benzyl alcohol, benzyl acetate, cinnamaldehyde, cinnamic alcohol, carvacrol, carveol, citral, citronellal, citronellol, p-cymene, diethyl phthalate, dimethyl salicylate, dipropylene glycol, eucalyptol (cineole), eugenol, iso-eugenol, galaxolide, geraniol, guaiacol, ionone, menthol, menthyl salicylate, methyl anthranilate, methyl ionone, methyl salicylate, a-phellandrene, pennyroyal oil, perillaldehyde, 1- or 2-phenyl ethyl alcohol, 1- or 2-phenyl ethyl propionate, piperonal, piperonyl acetate, piperonyl alcohol, D-pulegone, terpinen-4-ol, terpinyl acetate, 4-tert-butylcyclohexyl acetate, thyme oil, thymol, metabolites of trans-anethole, vanillin, ethyl vanillin, cedarwood oil, hexadecyltrimethylammonium chloride, aluminium chlorohydrate, 1-propoxypropanol-2, polyquarternium-10, silica gel, propylene glycol alginate, ammonium sulphate, hinokitiol, L-ascorbic acid, tannic acid and deriviatives, chlorohexidine, maleic anhydride, hinoki oil, a composite of AgCl and $TiO_2$, diazolidinyl urea, 6-isopropyl-m-cresol, urea, cyclodextrin, hydrogenated hop oil, polyvinylpyrrolidone, N-methylpyrrolidone, the sodium salt of anthraquinone, potassium thioglycolate, and glutaraldehyde, jasmone, dihydrojasmone, lower alkyl esters of jasmonic acid, lower alkyl esters of dihydrojasmonic acid, farnesol, nerolidol, phytol, isophytol, geranylgeraniol, and the like. The essential oil can also be selected from oil is selected from the group of Anise, Balsam, Basil, Bay, Birch, Cajeput, Camphor, Caraway, Cinnamon, Clove, Coriander, Dill, Fennell, Fir, Garlic, Lavender, Lavendin, Lemongrass, Marjoram, Nutmeg, Peppermint, Pine, Rosemary, Rue, Sage, Spearmint, Tea Tree, Thuja, Thyme, Wintergreen and Ylang-Ylang. Preferred essential oils include a-terpineol, eugenol, cinnamic alcohol, benzyl acetate, 2-phenyl ethyl alcohol, and benzyl alcohol.

G. Soil and Stain Resist Agents

Soil resist agents resist or repel dirt, oil, or other typically hydrophobic substances from the carpet. Fluorochemical soil-resist agents may include polymers or compounds having pendent or end groups of perfluoroalkyl moieties, fluorosurfactants, or fluoro-intermediates. Examples of some suitable fluorochemical soil-resist agents include ZONYL 7950 and ZONYL 5180, which are available from DuPont. When employed the soil and stain resist agents are preferably present at a level of from 0.01% to 5% and preferably from 0.1 to 1% of the composition The optional stain-resist agent may also be selected from the group consisting of copolymers of hydrolyzed maleic anhydride with aliphatic alpha olefins, aromatic olefins, or vinyl ethers, poly (vinyl methyl ether/maleic acid) copolymers, homopolymers of methacrylic acid, and copolymers of methacrylic acid. Suitable poly (vinyl methyl ether/maleic acid) copolymers are commercially available, for instance, from ISP Corporation, New York, N.Y. and Montreal, Canada under the product names GANTREZ AN Copolymer (AN-119 copolymer, average molecular weight of 20,000; AN-139 copolymer, average molecular weight of 41,000; AN-149 copolymer, average molecular weight of 50,000; AN-169 copolymer, average molecular weight of 67,000; AN-179 copolymer, average molecular weight of 80,000), GANTREZ S (GANTREZ S97, average molecular weight of 70,000), and GANTREZ ES (ES-225, ES-335, ES-425, ES-435), GANTREZ V (V-215, V-225, V-425). Preferably, the stain-resist agent is ZELAN 338, which is available from DuPont.

Suitable anti-resoiling polymers also include soil suspending polyamine polymers. Particularly suitable polyamine polymers are alkoxylated polyamines including so-called ethoxylated polyethylene amines, i.e., the polymerized reaction product of ethylene oxide with ethyleneimine. Suitable ethoxylated polyethylene amines are commercially available from Nippon Shokubai CO., LTD under the product names ESP-0620A (ethoxylated polyethylene amine wherein n=2 and y=20) or from BASF under the product names ES-8165 and from BASF under the product name LUTENSIT K-187/50.

Suitable anti-resoiling polymers also include polyamine N-oxide polymers. The polyamine N-oxide polymer can be obtained in almost any degree of polymerization. Typically, the average molecular weight is within the range of 1,000 to 100,000; more preferred 5,000 to 100,000; most preferred 5,000 to 25,000. Suitable poly vinyl pyridine-N-oxide polymers are commercially available from Hoechst under the trade name of Hoe S 4268, and from Reilly Industries Inc. under the trade name of PVNO.

Furthermore, suitable anti-resoiling polymers include N-vinyl polymers. Suitable N-vinyl polymers include polyvinyl pyrrolidone polymers, co-polymers of N-vinylpyrrolidone and N-vinylimidazole, co-polymers of N-vinylpyrrolidone and acrylic acid, and mixtures thereof. Suitable co-polymers of N-vinylpyrrolidone and N-vinylimidazole are commercially available from BASF, under the trade name of Sokalan PG55. Suitable vinylpyrrolidone homopolymers, are commercially available from BASF under the trade names LUVISKOL K15 (viscosity molecular weight of 10,000), LUVISKOL K25 (viscosity molecular weight of 24,000), LUVISKOL K30 (viscosity molecular weight of 40,000), and other vinyl pyrrolidone homopolymers known to persons skilled in the detergent field (see for example EP-A-262,897 and EP-A-256,696). Suitable copolymers of N-vinylpyrrolidone and acrylic acid are commercially available from BASF under the trade name SOKALAN PG 310. Preferred N-vinyl polymers are polyvinyl pyrrolidone polymers, co- polymers of N- vinylpyrrolidone and N-vinylimidazole, co-polymers of N-vinylpyrrolidone and acrylic acid, and mixtures thereof, even more preferred are polyvinyl pyrrolidone polymers.

Suitable anti-resoiling polymers also include soil suspending polycarboxylate polymers. Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenernalonic acid. The presence in the polymeric polycarboxylates herein of monomeric segments, containing no carboxylate radicals such as vinylmethyl ether, styrene, ethylene, etc. is suitable provided that such segments do not constitute more than 40%.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in U.S. Pat. No. 3,308,067 to Diehl.

Acrylic/maleic-based copolymers may also be used as a preferred soil suspending polycarboxylic polymer. Such materials include the water- soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in EP Application No. 66915. Particularly preferred is a copolymer of maleic/acrylic acid with an average molecular weight of 70,000. Such copolymers are commercially available from BASF under the trade name SOKALAN CP5.

Other suitable anti-resoiling polymers include those anti-resoiling polymers having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate: $C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (v) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerization of from about 1 to about 200, although higher levels can be used, preferably from 3 to about 150, more preferably from 6 to about 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580 to Gosselink.

Anti-resoiling polymers also include cellulosic derivatives such as hydroxyether cellulosic polymers, co-polymeric blocks of ethylene terephthalate or propylene terephthalate with polyethylene oxide or polypropylene oxide terephthalate, and the like. Such anti-resoiling polymers are commercially available and include hydroxyethers of cellulose such as METHOCEL (Dow). Cellulosic anti-resoiling polymers for use herein also include those selected from the group consisting of $C_1$–$C_4$ alkyl and $C_4$ hydroxyalkyl cellulose; see U.S. Pat. No. 4,000,093 to Nicol, et al. Anti-resoiling polymers characterised by poly(vinyl ester)hydrophobe segments include graft co-polymers of poly(vinyl ester), e.g., $C_1$–$C_6$ vinyl esters, preferably poly(vinyl acetate) grafted onto polyalkylene oxide backbones, such as polyethylene oxide backbones. See EP Application 0 219 048 to Kud, et al. Commercially available anti-resoiling polymers of this kind include the SOKALAN type of material, e.g., SOKALAN HP-220, available from BASF.

One type of preferred anti-resoiling polymers is a copolymer having random blocks of ethylene terephthalate and polyethylene oxide (PEO) terephthalate. The molecular weight of this anti-resoiling polymers is in the range of from about 25,000 to about 55,000. See U.S. Pat. No. 3,959,230 to Hays and U.S. Pat. No. 3,893,929 to Basadur.

Another preferred anti-resoiling polymers is a polyester with repeat units of ethylene terephthalate units which contains 10–15% of ethylene terephthalate units together with 90–80% of polyoxyethylene terephthalate units, derived from a polyoxyethylene glycol of average molecular weight 300–5,000. Examples of this polymer include the commercially available material ZELCON 51260 (from Dupont) and MILEASE T (from ICI). See also U.S. Pat. No. 4,702,857 to Gosselink.

Another preferred anti-resoiling polymers agent is a sulfonated product of a substantially linear ester oligomer comprised of an oligomeric ester backbone of terephthaloyl and oxyalkyleneoxy repeat units and terminal moieties covalently attached to the backbone. These anti-resoiling polymers are fully described in U.S. Pat. No. 4,968,451 to Scheibel and Gosselink. Other suitable anti-resoiling polymers include the terephthalate polyesters of U.S. Pat. No. 4,711,730 to Gosselink et al, the anionic end-capped oligomeric esters of U.S. Pat. No. 4,721,580 to Gosselink, and the block polyester oligomeric compounds of U.S. Pat. No. 4,702,857 to Gosselink.

Preferred anti-resoiling polymers also include the soil release agents that are disclosed in U.S. Pat. No. 4,877,896 to Maldonado et al, which discloses anionic, especially sulfoaroyl, end-capped terephthalate esters.

Still another preferred anti-resoiling agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred anti-resoiling agent of this type comprises about one sulfoisophthaloyl unit, 5 terephthaloyl units, oxyethyleneoxy and oxy-1,2-propyleneoxy units in a ratio of from about 1.7 to about 1.8, and two end-cap units of sodium 2-(2-hydroxyethoxy)-ethanesulfonate. Said anti-resoiling agent also comprises from about 0.5% to about 20%, by weight of the oligomer, of a crystalline-reducing stabilizer, preferably selected from the group consisting of xylene sulfonate, cumene sulfonate, toluene sulfonate, and mixtures thereof. See U.S. Pat. No. 5,415,807 to Gosselink et al.

H. Builder and Buffering Agents

The cleaning composition may include a builder detergent which increase the effectiveness of the surfactant. The builder detergent can also function as a softener and/or a sequestering and buffering agent in the cleaning composition. When employed, the builder detergent comprises at least about 0.001% and typically about 0.01–5% of the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl)amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolarnide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other suitable buffers include ammonium carbarnate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see McCutcheon's *Emulsifiers and Detergents*, North American Edition, 1997, McCutcheon Division, MC Publishing Company Kirk and WO 95/07971.

Propellant

The cleaning composition is delivered in the form of an aerosol with the aid of a propellant which can comprise, for example, a hydrocarbon, of from 1 to 10 carbon atoms, such as methane, ethane, n-propane, n-butane, isobutane, n-pentane, isopentane, and mixtures thereof. The propellant may also be selected from halogenated hydrocarbons including, for example, fluorocarbons, chlorocarbons, chlorofluorocarbons, and mixtures thereof. (Besides of concerns about the destruction of the stratosphere's ozone layer, the use of fluorocarbons and chlorofluorocarbons is less preferred.) Examples of other suitable propellants are found in P. A. Sanders *Handbook of Aerosol Technology* (Van Nostrand Reinhold Co.) (1979) 2nd Ed., pgs. 348–353 and 364–367, which are incorporated by reference herein. Further, non-hydrocarbon propellants may be possible, such as carbon dioxide, nitrogen, compressed air, and, possibly, dense or supercritical fluids.

A liquefied gas propellant mixture comprising about 85% isobutane and 15% propane is preferred because it provides sufficient pressure to expel the cleaning composition from the container and provides good control over the nature of the spray upon discharge of the aerosol formulation. Preferably, the propellants comprises about 1% to 50%, more preferably about 2% to 25%, and most preferably about 5% to 15% of the aerosol formulation.

The aerosol formulation, which is the mixture of cleaning composition and propellant, is preferably stored in and dispensed from a pressurized can that is equipped with a nozzle so that an aerosol of the formulation can be readily sprayed onto a surface. In loading the dispenser, the non-propellant components of the aerosol formulation are mixed into a concentrate and loaded into the dispenser first. Thereafter, the liquefied gaseous propellant is inserted before the dispenser is fitted with a nozzle.

In normal aerosol carpet cleaning, the foam can be very stable up to 5 to 10 minutes. Because this cleaning implement is designed to clean large areas easily, it is preferred that the foam be visible and consumer noticeable, however, it should be easily dispersed. The preferred foam of the invention is stable for only 1 to 2 minutes. The cleaning pad may contain antifoam ingredients that cause the foam to break as the cleaning head is moved over the foam.

What is claimed is:

1. A cleaning head assembly adapted for use with a removable cleaning pad that comprises:

(a) a cleaning head member having a first surface and a second surface;

(b) a rake swingarm having first and second ends with the first end pivotably mounted on one side of the cleaning head member and the second end detachably mounted on an opposite side of the cleaning head member;

(c) bristles secured to and projecting from the rake swingarm;

(d) securing means, engaged to the cleaning head member, for securing a cleaning pad to the cleaning head member; and (e) a cleaning pad capable of being secured by the securing means to the cleaning head member wherein the cleaning pad includes a cut-out region on each of two opposite sides wherein each cut-out region is dimensioned to correspond to one of first and second mounting positions for the ends of the rake swingarm.

2. The cleaning head assembly of claim 1 wherein the bristles form at least one row of projecting bristles.

3. The cleaning head assembly of claim 2 wherein the bristles are about 0.1 to 0.3 inches apart.

4. The cleaning head assembly of claim 2 wherein the bristles have a diameter of about 0.04 to 0.08 inches.

5. The cleaning head assembly of claim 1 wherein the bristles form two or more rows of projecting bristles with at least one row comprising longer bristles having a height greater than that of at least one other row of shorter bristles.

6. The cleaning head assembly of claim 5 wherein the longer bristles are about 0.25 to 0.50 inches tall and the shorter bristles are about 0.05 to 0.2 inches shorter than the longer bristles.

7. The cleaning head assembly of claim 5 wherein the bristles form at least three rows of bristles wherein the lengths thereof are not substantially uniform.

8. The cleaning head assembly of claim 5 wherein the bristles form three rows of bristles with the middle row comprising bristles whose lengths are longer than those of the other two rows of bristles.

9. The cleaning head assembly of claim 8 wherein the bristles of the middle row are about 0.25 to 0.5 inches tall and the other bristles are about 0.05 to 0.2 inches shorter.

10. The cleaning head assembly of claim 9 wherein the bristles are about 0.1 to 0.3 inches apart.

11. The cleaning head assembly of claim 10 wherein the bristles have a diameter of about 0.04 to 0.08 inches.

12. The cleaning head assembly of claim 11 wherein the first surface has a rectangular outer contour and the bristles are located along a line traversing the length of the first surface.

13. The cleaning head assembly of claim 1 wherein the first surface has a rectangular outer contour and the bristles are located along a line traversing the length of the first surface.

14. The cleaning head assembly of claim 1 wherein the first surface defines a groove into which the swingarm is positioned.

15. The cleaning head assembly of claim 1 wherein the first surface is substantially planar.

16. The cleaning head assembly of claim 1 wherein the second surface includes a receiving structure in which the distal end of a pole can be attached.

17. The cleaning head assembly of claim 1 wherein the means for securing the cleaning pad comprises a plurality of stays formed on the second surface.

18. The cleaning head assembly of claim 17 wherein the cleaning head member includes a lower surface onto which a removable cleaning pad is attached and the cleaning pad defines one or more slits that are attached to corresponding stays on an upper surface of the cleaning head member.

19. The cleaning head assembly of claim 18 wherein the one or more slits are each substantially linear with a length of from 0.5 to 2 inches and a width of from 0.05 to 1 inch.

20. The cleaning head assembly of claim 19 wherein each slit is cut at an angle of between 0 to 90 degrees relative to a side of the cleaning pad.

21. The cleaning head assembly of claim 1 wherein the cleaning head member includes a lower surface onto which a removable cleaning pad is attached and further comprising roller means for maneuvering the cleaning head member over the surface to be cleaned and wherein the roller means is mounted to the cleaning head member.

22. The cleaning head assembly of claim 1 wherein the cleaning head member comprises a curved upper surface and a lower surface onto which the removeable cleaning pad is attached.

23. The cleaning head assembly of claim 1 wherein the cleaning head member has a cleaning pad attached thereto and the cleaning pad has incorporated therein one or more agents that is selected from the group consisting of a miticide and anti-allergen agents, soil and stain resist agents, abrasives, antifoam agents, lubricants to enhance glide, dirt attracting polymers, odor absorbing agents, wetting agents, and mixtures thereof.

24. The cleaning head assembly of claim 1 wherein the bristles project from the first surface of the cleaning head member and wherein the first surface with said bristles exhibits a glide force of from about 10 to 30 pounds of force.

25. The cleaning head assembly of claim 1 wherein the bristles project from the first surface of the cleaning head member and wherein the first surface with the bristles exhibits a glide force of from about 12 to 18 pounds of force.

26. The cleaning head assembly of claim 1 wherein the bristles project from the first surface of the cleaning head member, wherein a cleaning pad is also secured to the first surface and wherein the first surface with the bristles and cleaning pad exhibits a glide force of from about 15 to 40 pounds of force.

27. The cleaning head assembly of claim 1 wherein the bristles project from the first surface of the cleaning head member, wherein a cleaning pad is also secured to the first surface and wherein the first surface with the bristles and cleaning pad exhibits a glide force of from about 15 to 30 pounds of force.

* * * * *